US011932923B2

(12) United States Patent
Luo et al.

(10) Patent No.: US 11,932,923 B2
(45) Date of Patent: Mar. 19, 2024

(54) STRUCTURAL DIE CAST ALUMINUM ALLOYS

(71) Applicant: Ohio State Innovation Foundation, Columbus, OH (US)

(72) Inventors: Alan Luo, Columbus, OH (US); Emre Cinkilic, Columbus, OH (US); Michael Moodispaw, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 17/489,038

(22) Filed: Sep. 29, 2021

(65) Prior Publication Data

US 2022/0098706 A1 Mar. 31, 2022

Related U.S. Application Data

(60) Provisional application No. 63/085,016, filed on Sep. 29, 2020.

(51) Int. Cl.

| | |
|---|---|
| ***C22C 21/02*** | (2006.01) |
| ***C22C 1/02*** | (2006.01) |
| ***C22F 1/043*** | (2006.01) |

(52) U.S. Cl.

CPC ..... *C22C 21/02* (2013.01); *C22C 1/026* (2013.01); *C22F 1/043* (2013.01)

(58) Field of Classification Search

CPC ..... C22C 21/02; C22C 1/026; C22F 1/043

See application file for complete search history.

(56) References Cited

U.S. PATENT DOCUMENTS 6,267,829 B1 * 7/2001 Backerud ..... C22C 21/04 148/438

OTHER PUBLICATIONS

Wu, Xiaoyan, et al. "Effect of cooling rate and Co content on the formation of Fe-rich intermetallics in hypoeutectic Al7Si0. 3Mg alloy with 0.5% Fe." Materials Characterization 139 (2018): 116-124. (Year: 2018).*

Bosch, Dominik, et al. "Secondary Al—Si—Mg high-pressure die casting alloys with enhanced ductility." Metallurgical and Materials Transactions A 46.3 (2015): 1035-1045. (Year: 2015).*

Kevin R. Anderson, "Technical Advancements in the Secondary Aluminum Industry", Light Metals Division Luncheon, TMS Annual Meeting, San Antonio, TX, Mar. 13, 2019.

Taylor, John A. "Iron-containing intermetallic phases in Al—Si based casting alloys." Procedia Materials Science 1 (2012): 19-33.

Seifeddine, Salem, Sten Johansson, and Ingvar L. Svensson. "The influence of cooling rate and manganese content on the β-A15FeSi phase formation and mechanical properties of Al—Si-based alloys." Materials Science and Engineering: A 490.1-2 (2008): 385-390.

Cinkilic, E., et al. "A formation map of iron-containing intermetallic phases in recycled cast aluminum alloys." Metallurgical and Materials Transactions A 50.12 (2019): 5945-5956.

Taub, Alan I., and Alan A. Luo. "Advanced lightweight materials and manufacturing processes for automotive applications." Mrs Bulletin 40.12 (2015): 1045-1054.

(Continued)

*Primary Examiner* — Ricardo D Morales

(74) *Attorney, Agent, or Firm* — Meunier Carlin & Curfman LLC

(57) ABSTRACT

Disclosed are aluminum alloys with high iron content and methods of making and using.

12 Claims, 25 Drawing Sheets

(56) References Cited

OTHER PUBLICATIONS

Kaufman, John Gilbert, and Elwin L. Rooy. Aluminum alloy castings: properties, processes, and applications. Asm International, 2004.
Joost, William J. "Reducing vehicle weight and improving US energy efficiency using integrated computational materials engineering." Jom 64.9 (2012): 1032-1038.
Gaustad, Gabrielle, Elsa Olivetti, and Randolph Kirchain. "Improving aluminum recycling: A survey of sorting and impurity removal technologies." Resources, Conservation and Recycling 58 (2012): 79-87.
Nakajima, Kenichi, et al. "Thermodynamic analysis of contamination by alloying elements in aluminum recycling." Environmental science & technology 44.14 (2010): 5594-5600.
Couture A, "Iron in aluminium casting alloys—a literature survey", AFS International Cast Metals Journal, 6(4), pp. 9-17, 1981.
Crepeau: Trans. Am. Foundrymen's Soc., 1995, vol. 103, pp. 361-366.
Terzi, S., et al. "In situ study of nucleation and growth of the irregular α-Al/β- Al5FeSi eutectic by 3-D synchrotron X-ray microtomography." Acta Materialia 58.16 (2010): 5370-5380.
Dinnis, Cameron M., John A. Taylor, and Arne K. Dahle. "As-cast morphology of iron-intermetallics in Al—Si foundry alloys." Scripta materialia 53.8 (2005): 955-958.
Puncreobutr, C., et al. "In situ quantification of the nucleation and growth of Fe-rich intermetallics during Al alloy solidification." Acta Materialia 79 (2014): 292-303 . . . .
Hwang, J. Y., H. W. Doty, and M. J. Kaufman. "The effects of Mn additions on the microstructure and mechanical properties of Al—Si—Cu casting alloys." Materials Science and Engineering: A 488.1-2 (2008): 496-504.
Bosch, Dominik, et al. "Secondary Al—Si—Mg high-pressure die casting alloys with enhanced ductility." Metallurgical and Materials Transactions A 46.3 (2015): 1035-1045.
Gorny, Anton, et al. "Evolution of Fe based intermetallic phases in Al—Si hypoeutectic casting alloys: Influence of the Si and Fe concentrations, and solidification rate." Journal of Alloys and Compounds 577 (2013): 103-124.
Awano, Y., and Y. Shimizu. "Non-equilibrium crystallization of AlFeSi compound in melt-superheated Al—Si alloy castings." AFS Transactions 98 (1990): 889-895.
Kral, M. V. (2005). A crystallographic identification of intermetallic phases in Al—Si alloys. Materials Letters, 59(18), 2271-2276. doi: 10.1016/j.matlet.2004.05.091.
Narayanan, L. Anantha, F. H. Samuel, and J. E. Gruzleski. "Crystallization behavior of iron-containing intermetallic compounds in 319 aluminum alloy." Metallurgical and Materials Transactions A 25.8 (1994): 1761-1773.
Dinnis, C. M., J. A. Taylor, and A. K. Dahle. "Interactions between iron, manganese, and the Al—Si eutectic in hypoeutectic Al—Si alloys." Metallurgical and Materials transactions A 37.11 (2006): 3283-3291.
Shabestari, S. G. "The effect of iron and manganese on the formation of intermetallic compounds in aluminum-silicon alloys." Materials Science and Engineering: A 383.2 (2004): 289-298.
Liu, Kun, Xin-jin Cao, and X-G. Chen. "Effect of Mn, Si, and cooling rate on the formation of iron-rich intermetallics in 206 Al—Cu cast alloys." Metallurgical and Materials Transactions B 43.5 (2012): 1231-1240.
Ji, Shouxun, et al. "Effect of iron on the microstructure and mechanical property of Al—Mg—Si—Mn and Al—Mg—Si diecast alloys." Materials Science and Engineering: A 564 (2013): 130-139.
Schmid-Fetzer, Rainer, and Fan Zhang. "The light alloy Calphad databases PanAl and PanMg." Calphad 61 (2018): 246-263.
Cao, Xinjin, and John Campbell. "The solidification characteristics of Fe-rich intermetallics in Al-11.5 Si-0.4 Mg cast alloys." Metallurgical and Materials Transactions A 35.5 (2004): 1425-1435.
Isono, N., et al. "Anomalous diffusion of Fe in Liquid Al Measured by the pulsed laser technique." Metallurgical and Materials Transactions A 27.3 (1996): 725-730.

* cited by examiner

Table I. The Morphology of Fe-Containing Intermetallics Directly Affect the Ductility of the Al-Si-Mg Alloys

| Fe-Rich Intermetallic | Crystal Structure | Morphology | Ductility Loss |
|---|---|---|---|
| $\beta$-$Al_5FeSi$ | monoclinic[18] (platelets) |  | severe |
| $\alpha$-$Al_8Fe_2Si$ | hexagonal[18] (Chinese script) |  [16] | less severe |
| $\alpha$-$Al_{15}(Fe,Mn)_3Si_2$ | cubic[18] (Chinese script) |  | less severe |

(e)

Low Fe

| Company | Alloy | Si | Mg | Fe | Mn | Cu | Ti | Sr |
|---|---|---|---|---|---|---|---|---|
| Rheinfelden | Silafont36 | 9.5-11.5 | 0.1-0.5 | ≤ 0.15 | 0.5-0.8 | ≤ 0.03 | ≤ 0.15 | 0.01-0.02 |
| Rio Tinto | Aural 2 | 10-11 | 0.1-0.6 | 0.15-0.2 | 0.45-0.55 | - | 0.04-0.08 | 0.01-0.016 |
| Alcoa | EZCast | 6.5-9.5 | 0.3-0.6 | ≤ 0.12 | 0.2-0.6 | - | ≤ 0.2 | 0.02-0.03 |
| Mercury | A367 | 8.5-9.5 | 0.3-0.5 | ≤ 0.25 | 0.25-0.35 | ≤ 0.25 | - | 0.05-0.07 |

Shock Tower

Permanent Mold Tensile Bar Castings

F Temper Mechanical Properties

| Alloy | Fe | Mn | YS (MPa) | UTS (MPa) | Elongation % |
|---|---|---|---|---|---|
| EZCast by Alcoa (primary alloy) | 0.2max | 0.1-0.8 | 105-140 | 250-280 | 7.5-13 |
| AlSiMgMn-50ppmSr (~50% secondary alloy) | 0.7 | 0.2 | 133.5 | 238.5 | 9.2 |
| AlSiMgMn-100ppmSr (~50% secondary alloy) | 0.7 | 0.2 | 124.5 | 234.2 | 9.2 |

(a)→250-ton Bühler H-250 SC die casting machine (b)→Test·specimens¤

STRUCTURAL DIE CAST ALUMINUM ALLOYS

CROSS-REFERENCE TO RELATED APPLICATIONS

The application claims the benefit of U.S. Provisional Application No. 63/085,016, filed Sep. 29, 2020, which is hereby incorporated herein by reference in its entirety.

STATEMENT REGARDING FEDERALLY SPONSORED RESEARCH OR DEVELOPMENT

This invention was made with government support under grant number DE-EE0007897 awarded by the Department of Energy and grant/contract number CMMI 1432688 awarded by the National Science Foundation. The government has certain rights in the invention.

BACKGROUND

The demand for improved fuel economy and lower greenhouse gas emission without compromising passenger safety and performance has led to increased use of lightweight materials in vehicles over the last few decades. Such demand has made aluminum alloys the material of choice for many automotive applications because of their lightweight, good specific strength, and exceptional corrosion resistance. However, the high costs of primary aluminum production and component manufacturing often limit the widespread usage of aluminum in the vehicle design. To achieve further weight reduction in light vehicles while maintaining the affordability, it is essential to lower the manufacturing cost of aluminum components.

Aluminum can be recycled many times with exceptional recovery rates, where the energy required to produce secondary or recycled aluminum is only 5 pct of the energy used in the production of primary aluminum. Such a reduction highlights strong economic and environmental benefits of utilizing recycled aluminum in production of parts for automotive industry. Despite the promising outlook for the use of secondary aluminum, there is a cascade effect from continued recycling of aluminum, i.e., accumulation of alloying/impurity elements such as Fe, Mg, Cu, Zn, etc., due to the difficulty in removing them in the recycling process. The result is that the properties of the recycled aluminum alloys can be significantly altered by the excess concentrations of these elements and renders the recycled material ill-suited for safety critical applications.

Of all impurity elements, Fe is considered the most detrimental, and its deleterious effect on the mechanical properties of Al—Si alloys is well known to the aluminum casting industry. Fe can form numerous intermetallic phases, such as, $\theta$-$Al_{13}Fe_4$, $\alpha$-$Al_8Fe_2Si$, $\beta$-$Al_5FeSi$, $\delta$-$Al_4FeSi_2$, $\pi$-$Al_8FeMg_3Si_2$, etc., when it is combined with other alloying elements. The size, morphology, and volume fraction of these Fe-containing intermetallics have a pronounced effect on the as-cast mechanical properties of Al—Si alloys. The most common and detrimental Fe-containing intermetallic observed in hypoeutectic Al—Si casting alloys is $\beta$-$Al_5FeSi$ phase which forms as interconnected thin platelets with a needle-like appearance in a polished cross-section. The sharp tips of these platelets act as stress concentrators under loading and reduce the alloy ductility, rendering these alloys unusable for structural components.

There is a need to improve methods of recycling aluminum which afford alloys suitable for use in applications where high performance is needed.

There is a need to prevent the formation of undesirable intermetallic phases, such as the $\beta$-$Al_5FeSi$ phase, within recycled aluminum alloys.

The compositions and methods disclosed herein address these and other needs.

SUMMARY

Provided herein are aluminum alloys and methods of making. The aluminum alloys comprise aluminum, silicon, iron, and manganese.

The iron can be present in the aluminum alloy in a concentration greater than or equal to 0.3% by weight, based on the total weight of the aluminum alloy. In some embodiments, the iron is present in an amount ranging from 0.3% by weight to 1% by weight, based on the total weight of the aluminum alloy.

The manganese can be present in amount effective to suppress (or even eliminate) the formation of a $\beta$-$Al_5FeSi$ phase during casting of the aluminum alloy. In some embodiments, the manganese can be present in an amount ranging from 0.1% by weight to 1.3% by weight, based on the total weight of the aluminum alloy.

In some embodiments, the iron and manganese can be present in a ratio of 1:1 or less. For example, the iron and manganese can be present in a ratio ranging from 0.6:1 to 1:1, such as from 0.7:1 to 0.8:1. In other embodiments, the iron and manganese can be present in a ratio of at least 1.6:1. For example, the iron and manganese can be present in a ratio ranging from 1.6:1 to 2.6:1.

In some embodiments, the aluminum alloy can further include a strontium. In some embodiments, the strontium can be present in an amount ranging from 0.005% by weight (50 ppm) to 0.015% by weight (150 ppm), based on the total weight of the aluminum alloy.

In some embodiments, the silicon can be present in an amount of from 5% by weight to 12% by weight, based on the total weight of the aluminum alloy.

In some embodiments, the aluminum alloy can further include from 0.1% by weight to 0.5% by weight magnesium, based on the total weight of the aluminum alloy.

In some embodiments, the aluminum alloy can further include from greater than 0% by weight to 0.5% by weight copper, based on the total weight of the aluminum alloy.

Also described are methods of forming an aluminum alloy. These methods can comprise combining a secondary aluminum alloy with manganese to form the aluminum alloy; and cooling the aluminum alloy.

Also described are methods of improving mechanical properties of a secondary aluminum alloy, the methods comprising: adding manganese to the secondary aluminum alloy to form the aluminum alloy having improved mechanical properties; and cooling the aluminum alloy having improved mechanical properties.

These aluminum alloys can be any of the aluminum alloys described herein.

In some embodiments, the cooling step can comprise cooling the aluminum alloy at a cooling rate of from 0.1° C./s to 4° C./s, such as 1° C./s to 3° C./s. In other embodiments, the cooling step can comprise cooling the aluminum alloy at a cooling rate of from 3° C./s to 500° C./s, such as 11° C./s to 200° C./s.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Figure 1:
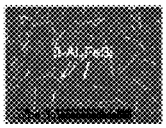
FIG. 1 shows the crystal structure, typical morphology, and their relative effect on ductility of Al—Si—Mg alloys of Fe-containing intermetallics.
Figure 1:
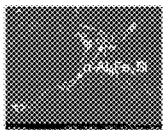
Figure 1:
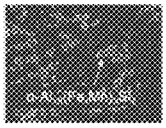
Figure 2A:
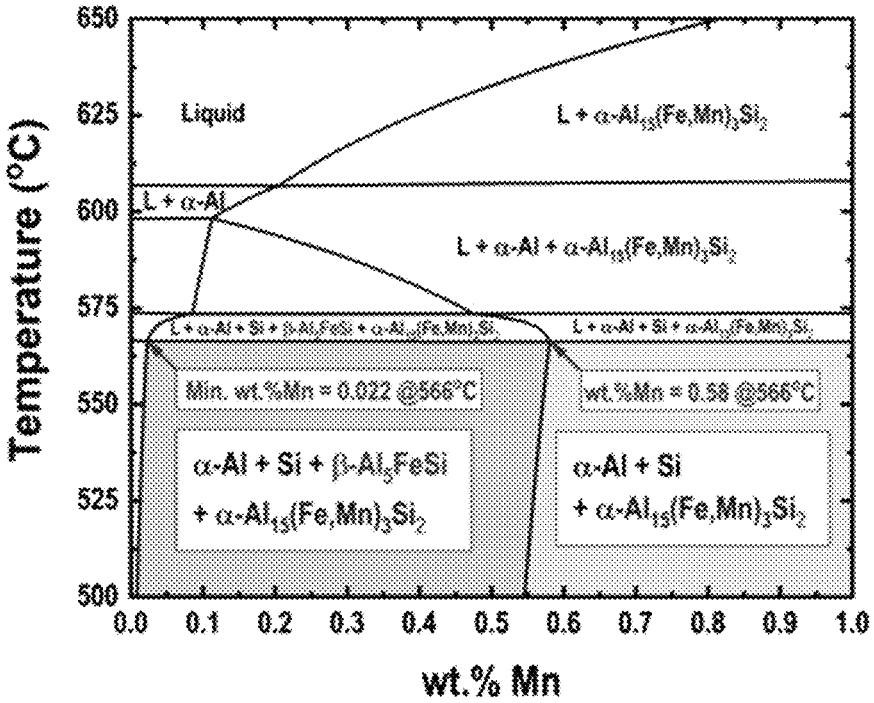
FIG. 2A-2G shows (2A) isopleth for Al-8 pct Si-0.35 pct Mg-0.6 pct Fe showing equilibrium phase constituents; (2B and 2C) the effect of Mg and Si content on the equilibrium phase stability; (2D and 2G) calculated equilibrium solidification paths; (2E) the change in total phase fraction of Fe-containing intermetallics with Mn concentration for Al-8 pct Si-0.35 pct Mg-0.6 pct Fe; and (2F) the effect of Fe and Mn content on the formation of $\beta$-$Al_5FeSi$ intermetallic phase for composition ranges of 7 to 10 pct Si, 0.35 to 0.5 pct Mg, 0.1 to 1.3 pct Mn, 0.1 to 1.3 pct Fe.
Figure 2B:
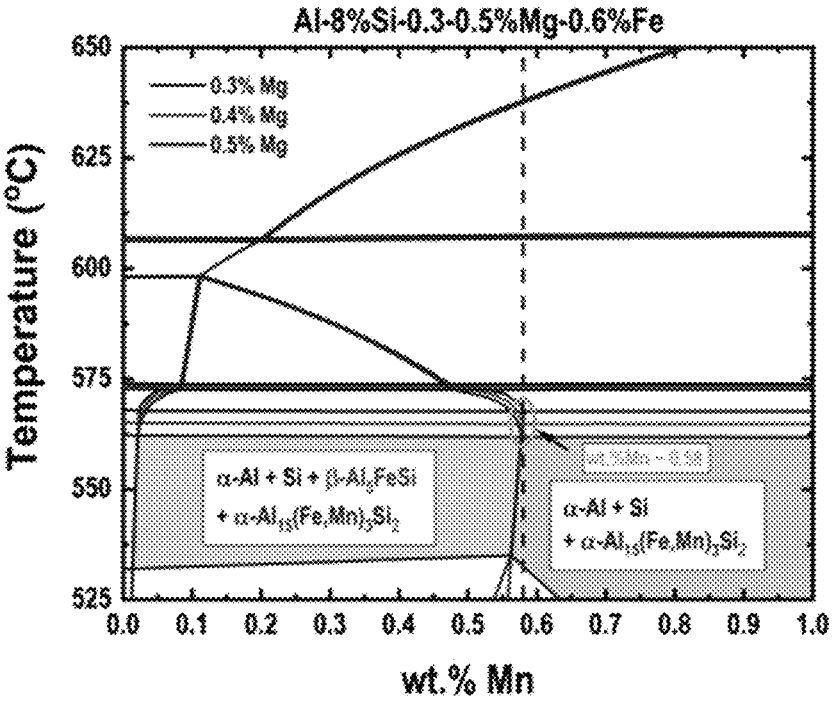
Figure 2C:
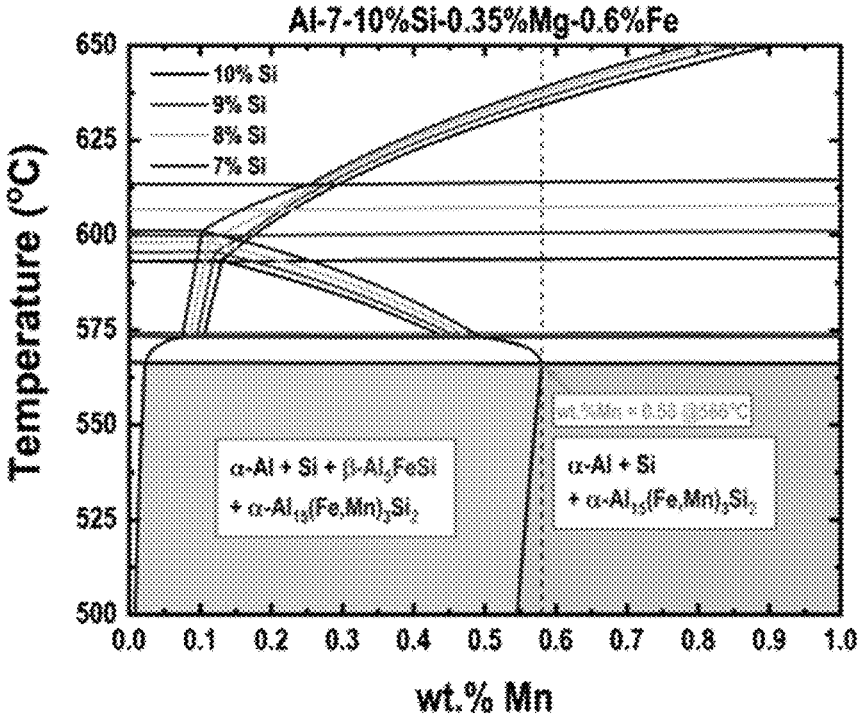
Figure 2D:
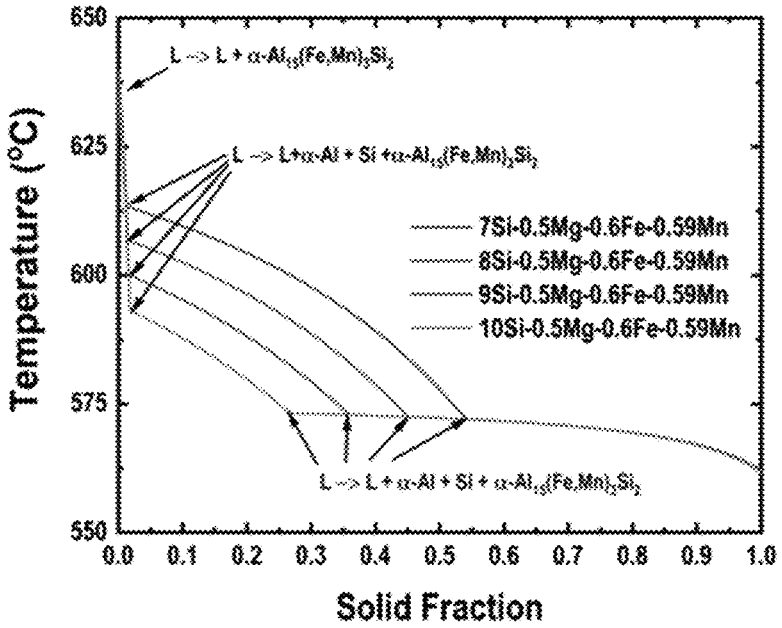
Figure 2E:
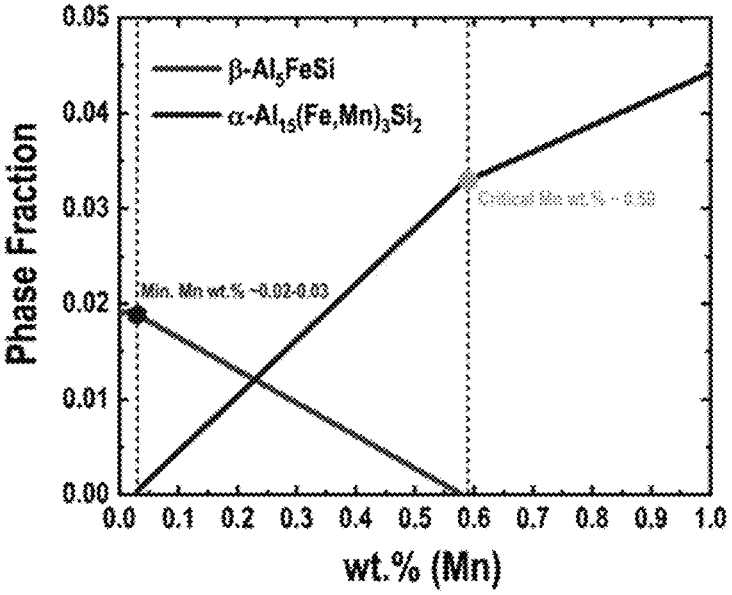
Figure 2F:
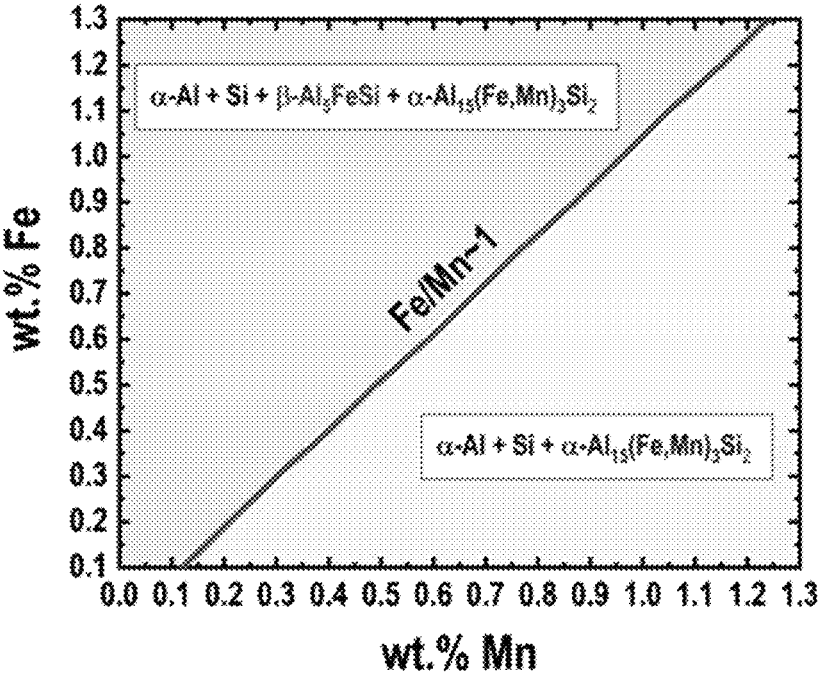
Figure 2G:
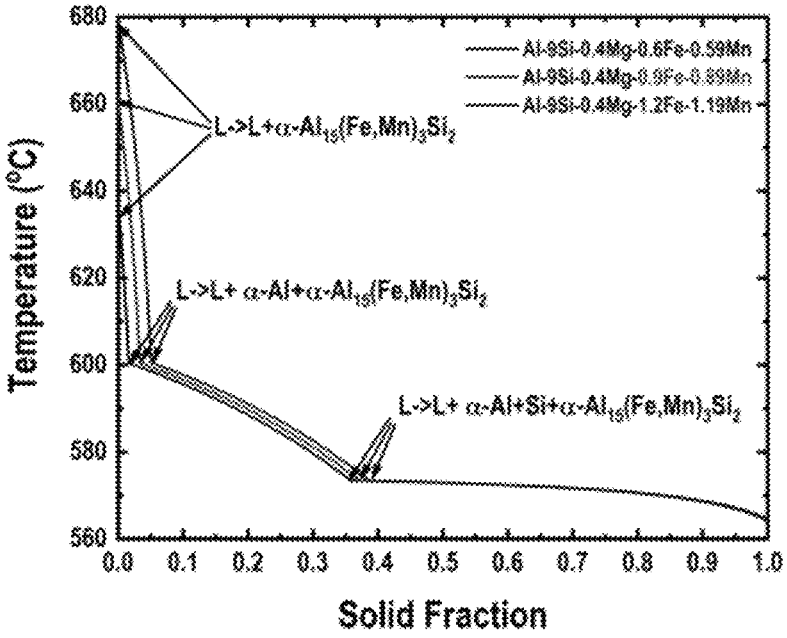

A number of embodiments of the disclosure have been described. Nevertheless, it will be understood that various modifications may be made without departing from the spirit and scope of the invention. Accordingly, other embodiments are within the scope of the following claims.

Definitions

To facilitate understanding of the disclosure set forth herein, a number of terms are defined below. Unless defined otherwise, all technical and scientific terms used herein generally have the same meaning as commonly understood by one of ordinary skill in the art to which this disclosure belongs. Publications cited herein and the materials for which they are cited are specifically incorporated by reference.

General Definitions

The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed. Other than where noted, all numbers expressing quantities of ingredients, reaction conditions, geometries, dimensions, and so forth used in the specification and claims are to be understood at the very least, and not as an attempt to limit the application of the doctrine of equivalents to the scope of the claims, to be construed in light of the number of significant digits and ordinary rounding approaches.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s), but may also include other elements or steps not expressly recited. Furthermore, as used herein, the use of the terms "a", "an", and "the" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%. Furthermore, a range may be construed to include the start and the end of the range. For example, a range of 10% to 20% (i.e., range of 10%-20%) can includes 10% and also includes 20%, and includes percentages in between 10% and 20%, unless explicitly stated otherwise herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

Ranges can be expressed herein as from "about" one particular value, and/or to "about" another particular value. By "about" is meant within 5% of the value, e.g., within 4, 3, 2, or 1% of the value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed.

As used herein, the terms "may," "optionally," and "may optionally" are used interchangeably and are meant to include cases in which the condition occurs as well as cases in which the condition does not occur. Thus, for example, the statement that a formulation "may include an excipient" is meant to include cases in which the formulation includes an excipient as well as cases in which the formulation does not include an excipient.

Reference will now be made in detail to specific aspects of the disclosed materials, compounds, compositions, articles, and methods, examples of which are illustrated in the accompanying Examples and Figures.

Aluminum Alloys

Disclosed herein are aluminum alloys comprising aluminum, silicon, iron, and manganese.

The manganese can be present in amount effective to suppress the formation of a β-$Al_5FeSi$ phase during casting of the aluminum alloy. In some embodiments, the manganese can be present in an amount of at least 0.1% by weight, based on the total weight of the aluminum alloy (e.g., at least 0.2% by weight, at least 0.3% by weight, at least 0.4% by weight, at least 0.5% by weight, at least 0.6% by weight, at least 0.7% by weight, at least 0.8% by weight, at least 0.9% by weight, at least 1% by weight, at least 1.1% by weight, or at least 1.2% by weight). In some embodiments, the manganese can be present in an amount of 1.3% by weight or less, based on the total weight of the aluminum alloy (e.g., 1.2% by weight or less, 1.1% by weight or less, 1% by weight or less, 0.9% by weight or less, 0.8% by weight or less, 0.7% by weight or less, 0.6% by weight or less, 0.5% by weight or less, 0.4% by weight or less, 0.3% by weight or less, 0.2% by weight or less).

The manganese can be present in an amount ranging from any of the minimum values described above to any of the maximum values described above. For example, in some embodiments, the manganese can be present in an amount ranging from 0.1% by weight to 1.3% by weight, based on the total weight of the aluminum alloy (e.g., from 0.1% by weight to 1.2% by weight, from 0.1% by weight to 1.1% by weight, from 0.1% by weight to 1% by weight, from 0.1% by weight to 0.9% by weight, from 0.1% by weight to 0.8% by weight, from 0.1% by weight to 0.7% by weight, from 0.1% by weight to 0.6% by weight, from 0.1% by weight to 0.5% by weight, from 0.1% by weight to 0.4% by weight, from 0.1% by weight to 0.3% by weight, from 0.1% by weight to 0.2% by weight, from 0.25% by weight to 1.2% by weight, from 0.25% by weight to 1.1% by weight, from 0.25% by weight to 1% by weight, from 0.25% by weight to 0.9% by weight, from 0.25% by weight to 0.8% by weight, from 0.25% by weight to 0.7% by weight, from 0.25% by weight to 0.6% by weight, from 0.25% by weight to 0.5% by weight, from 0.25% by weight to 0.4% by weight, from 0.25% by weight to 0.3% by weight, from 0.3% by weight to 1.2% by weight, from 0.3% by weight to 1.1% by weight, from 0.3% by weight to 1% by weight, from 0.3% by weight to 0.9% by weight, from 0.3% by weight to 0.8% by weight, from 0.3% by weight to 0.7% by weight, from 0.3% by weight to 0.6% by weight, from 0.3% by weight to 0.5% by weight, from 0.3% by weight to 0.4% by weight, from 0.4% by weight to 1.2% by weight, from 0.4% by weight to 1.1% by weight, from 0.4% by weight to 1% by weight, from 0.4% by weight to 0.9% by weight, from 0.4% by weight to 0.8% by weight, from 0.4% by weight to 0.7% by weight, from 0.4% by weight to 0.6% by weight, from 0.4% by weight to 0.5% by weight, from 0.5% by weight to 1.2% by weight, from 0.5% by weight to 1.1% by weight, from 0.5% by weight to 1% by weight, from 0.5% by weight to 0.9% by weight, from 0.5% by weight to 0.8% by weight, from 0.5% by weight to 0.7% by weight, from 0.5% by weight to 0.6% by weight, from 0.6% by weight to 1.2% by weight, from 0.6% by weight to 1.1% by weight, from 0.6% by weight to 1% by weight, from 0.6% by weight to 0.9% by weight, from 0.6% by weight to 0.8% by weight, from 0.6% by weight to 0.7% by weight, from 0.7% by weight to 1.2% by weight, from 0.7% by weight to 1.1% by weight, from 0.7% by weight to 1% by weight, from 0.7% by weight to 0.9% by weight, from 0.7% by weight to 0.8% by weight, from 0.1% by weight to 1.2% by weight, from 0.1% by weight to 1.1% by weight, from 0.8% by weight to 1% by weight, from 0.8% by weight to 0.9% by weight, from 0.9% by weight to 1.2% by weight, from 0.9% by weight to 1.1% by weight, from 0.9% by weight to 1% by weight, from 1% by weight to 1.2% by weight, from 1% by weight to 1.1% by weight, from 1.1% by weight to 1.3% by weight, from 1.1% by weight to 1.2% by weight, from 0.2% by weight to 1.3% by weight, from 0.3% by weight to 1.3% by weight, from 0.4% by weight to 1.3% by weight, from 0.5% by weight to 1.3% by weight, from 0.6% by weight to 1.3% by weight, from 0.7% by weight to 1.3% by weight, from 0.8% by weight to 1.3% by weight, from 0.9% by weight to 1.3% by weight, or from 1% by weight to 1.3% by weight).

In some embodiments, the iron can be present in the aluminum alloy in an amount greater than or equal to 0.3% by weight, based on the total weight of the aluminum alloy (e.g., greater than or equal to 0.4% by weight, greater than or equal to 0.5% by weight, greater than or equal to 0.6% by weight, greater than or equal to 0.7% by weight, greater than or equal to 0.8% by weight, or greater than or equal to 0.9% by weight). In some embodiments, the iron can be present in an amount of 1% by weight or less, based on the total weight of the aluminum alloy (e.g., 0.9% by weight or less, 0.8% by weight or less, 0.7% by weight or less, 0.6% by weight or less, 0.5% by weight or less, or 0.4% by weight or less). The iron can be present in an amount ranging from any of the minimum values described above to any of the maximum values described above. For example, in some embodiments, the iron is present in an amount ranging from 0.3% by weight to 1% by weight, based on the total weight of the aluminum alloy, (e.g, from 0.3% by weight to 0.9% by weight, from 0.3% by weight to 0.8% by weight, from 0.3% by weight to 0.7% by weight, from 0.3% by weight to 0.6% by weight, from 0.3% by weight to 0.5% by weight, from 0.3% by weight to 0.4% by weight, from 0.4% by weight to 1% by weight, from 0.4% by weight to 0.9% by weight, from 0.4% by weight to 0.8% by weight, from 0.4% by weight to 0.7% by weight, from 0.4% by weight to 0.6% by weight, from 0.4% by weight to 0.5% by weight, from 0.5% by weight to 1% by weight, from 0.5% by weight to 0.9% by weight, from 0.5% by weight to 0.8% by weight, from 0.5% by weight to 0.7% by weight, from 0.5% by weight to 0.6% by weight, from 0.6% by weight to 1% by weight, from 0.6% by weight to 0.9% by weight, from 0.6% by weight to 0.8% by weight, from 0.6% by weight to 0.7% by weight, from 0.7% by weight to 1% by weight, from 0.7% by weight to 0.9% by weight, from 0.7% by weight to 0.8% by weight, from 0.8% by weight to 1% by weight, from 0.8% by weight to 0.9% by weight, or from 0.9% by weight to 1% by weight).

In some embodiments, the iron and manganese can be present in a ratio of at least 0.6:1 (e.g., at least 0.65:1, at least 0.7:1, at least 0.75:1, at least 0.8:1, at least 0.85:1, at least 0.9:1, or at least 0.95:1). In some embodiments, the iron and manganese can be present in a ratio of 1:1 or less (e.g., 0.95:1 or less, 0.9:1 or less, 0.85:1 or less, 0.8:1 or less, 0.75:1 or less, or 0.7:1 or less). The iron and manganese can be present in a ratio from any of the minimum values described above to any of the maximum values described above. For example, in some embodiments, the iron and manganese can be present in a ratio ranging from 0.6:1 to 1:1, (e.g., from 0.6:1 to 0.9:1, from 0.6:1 to 0.8:1, from 0.6:1 to 0.7:1, from 0.7:1 to 0.8:1, from 0.7:1 to 0.9:1, from 0.7:1 to 1:1, from 0.8:1 to 0.9:1, from 0.8:1 to 1:1, or from 0.9:1 to 1:1).

In some embodiments, the iron and manganese can be present in a ratio of at least 1.6:1 (e.g., at least 1.7:1, at least 1.8:1, at least 1.9:1, at least 2:1, at least 2.1:1, at least 2.2:1, at least 2.3:1, at least 2.4:1, or at least 2.5:1). In some embodiments, the iron and manganese can be present in a ratio of 2.6:1 or less (e.g., 2.5:1 or less, 2.4:1 or less, 2.3:1 or less, 2.2:1 or less, 2.1:1 or less, 2:1 or less, 1.9:1 or less, 1.8:1 or less, or 1.7:1 or less). The iron and manganese can be present in a ratio from any of the minimum values described above to any of the maximum values described above. For example, in some embodiments, the iron and manganese can be present in a ratio ranging from 1.6:1 to 2.6:1, such as from 1.7:1 to 2.6:1, from 1.8:1 to 2.6:1, from 1.9:1 to 2.6:1, from 2:1 to 2.6:1, from 2.2:1 to 2.6:1, from 2.3:1 to 2.6:1, from 2.4:1 to 2.6:1, from 2.5:1 to 2.6:1, from 1.6:1 to 2.5:1, from 1.7:1 to 2.5:1, from 1.8:1 to 2.5:1, from 1.9:1 to 2.5:1, from 2:1 to 2.5:1, from 2.2:1 to 2.5:1, from 2.3:1 to 2.5:1, from 1.6:1 to 2.4:1, from 1.7:1 to 2.4:1, from 1.8:1 to 2.4:1, from 1.9:1 to 2.4:1, from 2:1 to 2.4:1, from 2.2:1 to 2.4:1, from 2.3:1 to 2.4:1, from 1.6:1 to 2.3:1, from 1.7:1 to 2.3:1, from 1.8:1 to 2.3:1, from 1.9:1 to 2.3:1, from 2:1 to 2.3:1, from 2.2:1 to 2.3:1, 1.6:1 to 2.2:1, from 1.7:1 to 2.2:1, from 1.8:1 to 2.2:1, from 1.9:1 to 2.2:1, from 2:1 to 2.2:1, from 1.6:1 to 2.1:1, from 1.7:1 to 2.1:1, from 1.8:1 to 2.1:1, from 1.9:1 to 2.1:1, from 2:1 to 2.1:1, from 1.6:1 to 2:1, from 1.7:1 to 2:1, from 1.8:1 to 2:1, from 1.9:1 to 2:1, from 1.6:1 to 1.9:1, from 1.7:1 to 1.9:1, from 1.8:1 to 1.9:1, from 1.6:1 to 1.8:1, from 1.7:1 to 1.8:1, or from 1.6:1 to 1.7:1.

In some embodiments, the silicon can be present in an amount of at least 5% by weight, based on the total weight of the aluminum alloy (e.g., at least 6% by weight, at least 7% by weight, at least 8% by weight, at least 9% by weight, at least 10% by weight, or at least 11% by weight). In some embodiments, the silicon can be present in an amount of 12% by weight or less, based on the total weight of the aluminum alloy (e.g., 11% by weight or less, 10% by weight or less, 9% by weight or less, 8% by weight or less, 7% by weight or less, 6% by weight or less). The silicon can be present in an amount ranging from any of the minimum values described above to any of the maximum values described above. For example, in some embodiments, the silicon can be present in an amount ranging from 5% by weight to 12% by weight, based on the total weight of the aluminum alloy (e.g., from 5% by weight to 11% by weight, from 5% by weight to 10% by weight, from 5% by weight to 9% by weight, from 5% by weight to 8% by weight, from 5% by weight to 7% by weight, from 5% by weight to 6% by weight, from 6% by weight to 11% by weight, from 6% by weight to 10% by weight, from 6% by weight to 9% by weight, from 6% by weight to 8% by weight, from 6% by weight to 7% by weight, from 7% by weight to 11% by weight, from 7% by weight to 10% by weight, from 7% by weight to 9% by weight, from 7% by weight to 8% by weight, from 8% by weight to 11% by weight, from 8% by weight to 10% by weight, from 8% by weight to 9% by weight, from 9% by weight to 11% by weight, from 9% by weight to 10% by weight, or from 10% by weight to 11% by weight).

In some embodiments, the aluminum alloy can further include a strontium. In some embodiments, the strontium can be present in an amount ranging from 0.005% by weight (50 ppm) to 0.015% by weight (150 ppm), based on the total weight of the aluminum alloy, such as from 0.005% by weight (50 ppm) to 0.010% by weight (100 ppm), from 0.005% by weight (50 ppm) to 0.009% by weight (90 ppm), from 0.005% by weight (50 ppm) to 0.008% by weight (80 ppm), from 0.005% by weight (50 ppm) to 0.007% by weight (70 ppm), from 0.005% by weight (50 ppm) to 0.006% by weight (60 ppm), from 0.006% by weight (60 ppm) to 0.010% by weight (100 ppm), from 0.006% by weight (60 ppm) to 0.009% by weight (90 ppm), from 0.006% by weight (60 ppm) to 0.008% by weight (80 ppm), from 0.006% by weight (60 ppm) to 0.007% by weight (70 ppm), from 0.007% by weight (70 ppm) to 0.010% by weight (100 ppm), from 0.007% by weight (70 ppm) to 0.009% by weight (90 ppm), from 0.007% by weight (70 ppm) to 0.008% by weight (80 ppm), from 0.008% by weight (80 ppm) to 0.010% by weight (100 ppm), from 0.008% by weight (80 ppm) to 0.009% by weight (90 ppm), from 0.009% by weight (90 ppm) to 0.010% by weight (100 ppm), from 0.006% by weight (60 ppm) to 0.015% by weight (150 ppm), from 0.007% by weight (70 ppm) to 0.015% by weight (150 ppm), from 0.008% by weight (80 ppm) to 0.015% by weight (150 ppm), from 0.009% by weight (90 ppm) to 0.015% by weight (150 ppm), such as from 0.01% by weight (100 ppm) to 0.015% by weight (150 ppm), from 0.012% by weight (120 ppm) to 0.015% by weight (150 ppm), from 0.011% by weight (110 ppm) to 0.015% by weight (150 ppm), from 0.013% by weight (130 ppm) to 0.015% by weight (150 ppm), or from 0.014% by weight (140 ppm) to 0.015% by weight (150 ppm).

In some embodiments, the aluminum alloy can further include a magnesium. In some embodiments, the magnesium can be present in an amount of at least 0.1% by weight, based on the total weight of the aluminum alloy (e.g., at least 0.1% by weight, at least 0.15% by weight, at least 0.2% by weight, at least 0.25% by weight, at least 0.3% by weight, at least 0.35% by weight, at least 0.4% by weight, or at least 0.45% by weight). In some embodiments, the magnesium can be present in an amount of 0.5% by weight or less, based on the total weight of the aluminum alloy (e.g., 0.45% by weight or less, 0.4% by weight or less, 0.35% by weight or less, 0.3% by weight or less, 0.25% by weight or less, 0.2% by weight or less, 0.15% by weight or less, or 0.1% by weight or less). The magnesium can be present in an amount ranging from any of the minimum values described above to any of the maximum values described above. For example, in some embodiments, the magnesium can be present in an amount ranging from 0.1% by weight to 0.5% by weight, based on the total weight of the aluminum alloy (e.g., from 0.1% by weight to 0.45% by weight, from 0.1% by weight to 0.4% by weight, from 0.1% by weight to 0.35% by weight, from 0.1% by weight to 0.3% by weight, from 0.1% by weight to 0.25% by weight, from 0.1% by weight to 0.2% by weight, from 0.1% by weight to 0.15% by weight, from 0.15% by weight to 0.45% by weight, from 0.15% by weight to 0.4% by weight, from 0.15% by weight to 0.35% by weight, from 0.15% by weight to 0.3% by weight, from 0.15% by weight to 0.25% by weight, from 0.15% by weight to 0.2% by weight, from 0.15% by weight to 0.5% by weight, from 0.2% by weight to 0.45% by weight, from 0.2% by weight to 0.4% by weight, from 0.2% by weight to 0.35% by weight, from 0.2% by weight to 0.3% by weight, from 0.2% by weight to 0.25% by weight, from 0.2% by weight to 0.5% by weight, from 0.35% by weight to 0.45% by weight, from 0.35% by weight to 0.4% by weight, from 0.35% by weight to 0.5% by weight, from 0.3% by weight to 0.45% by weight, from 0.3% by weight to 0.4% by weight, from 0.3% by weight to 0.35% by weight, from 0.3% by weight to 0.5% by weight, from 0.25% by weight to 0.45% by weight, from 0.25% by weight to 0.4% by weight, from 0.25% by weight to 0.35% by weight, from 0.25% by weight to 0.3% by weight, from 0.25% by weight to 0.5% by weight, from 0.4% by weight to 0.45% by weight, from 0.4% by weight to 0.5% by weight, or from 0.45% by weight to 0.5% by weight).

In some embodiments, the aluminum alloy can further include a copper. In some embodiments, the copper can be present in an amount of greater than 0% by weight, based on the total weight of the aluminum alloy (e.g., greater than 0.01%, greater than 0.02%, greater than 0.03%, greater than 0.04%, greater than 0.05% by weight, greater than 0.06%, greater than 0.07% by weight, greater than 0.08%, greater than 0.09% by weight, greater than 0.1% by weight, greater than 0.15%, greater than 0.2%, greater than 0.25%, greater than 0.3%, greater than 0.35%, greater than 0.4%, or greater than 0.45%). In some embodiments, the copper can be present in an amount of 0.5% by weight or less, based on the total weight of the aluminum alloy (e.g., 0.45% by weight or less, 0.4% by weight or less, 0.35% by weight or less, 0.3% by weight or less, 0.25% by weight or less, 0.2% by weight or less, 0.15% by weight or less, 0.14% by weight or less, 0.13% by weight or less, 0.12% by weight or less, 0.11% by weight or less, 0.10% by weight or less, 0.09% by weight or less, 0.08% by weight or less, 0.07% by weight or less, 0.06% by weight or less, 0.05% by weight or less, 0.04% by weight or less, 0.03% by weight or less, 0.02% by weight or less, or 0.01% by weight or less). The copper can be present in an amount ranging from any of the minimum values described above to any of the maximum values described above. For example, in some embodiments, the copper can be present in an amount ranging from greater than 0% by weight to 0.5% by weight, based on the total weight of the aluminum alloy (e.g., from greater than 0% by weight to 0.45% by weight, from greater than 0% by weight to 0.4% by weight, from greater than 0% by weight to 0.35% by weight, from greater than 0% by weight to 0.3% by weight, from greater than 0% by weight to 0.25% by weight, from greater than 0% by weight to 0.2% by weight, from greater than 0% by weight to 0.15% by weight, from greater than 0% by weight to 0.14% by weight, from greater than 0% by weight to 0.12% by weight, from greater than 0% by weight to 0.10% by weight, from greater than 0% by weight to 0.08% by weight, from greater than 0% by weight to 0.06% by weight, from greater than 0% by weight to 0.04% by weight, from greater than 0% by weight to 0.02% by weight, from 0.02% by weight to 0.45% by weight, from 0.02% by weight to 0.4% by weight, from 0.02% by weight to 0.35% by weight, from 0.02% by weight to 0.3% by weight, from 0.02% by weight to 0.25% by weight, from 0.02% by weight to 0.2% by weight, from 0.02% by weight to 0.15% by weight, from 0.02% by weight to 0.14% by weight, from 0.02% by weight to 0.12% by weight, from 0.02% by weight to 0.10% by weight, from 0.02% by weight to 0.08% by weight, from 0.02% by weight to 0.06% by weight, from 0.02% by weight to 0.04% by weight, from, from 0.05% by weight to 0.45% by weight, from 0.05% by weight to 0.4% by weight, from 0.05% by weight to 0.35% by weight, from 0.05% by weight to 0.3% by weight, from 0.05% by weight to 0.25% by weight, from 0.05% by weight to 0.2% by weight, from 0.05% by weight to 0.15% by weight, from 0.05% by weight to 0.14% by weight, from 0.05% by weight to 0.12% by weight, from 0.05% by weight to 0.10% by weight, from 0.05% by weight to 0.08% by weight, from 0.05% by weight to 0.06% by weight, from 0.08% by weight to 0.45% by weight, from 0.08% by weight to 0.4% by weight, from 0.08% by weight to 0.35% by weight, from 0.08% by weight to 0.3% by weight, from 0.08% by weight to 0.25% by weight, from 0.08% by weight to 0.2% by weight, from 0.08% by weight to 0.15% by weight, from 0.08% by weight to 0.14% by weight, from 0.08% by weight to 0.12% by weight, from 0.08% by weight to 0.10% by weight, from 0.1% by weight to 0.45% by weight, from 0.1% by weight to 0.4% by weight, from 0.1% by weight to 0.35% by weight, from 0.1% by weight to 0.3% by weight, from 0.1% by weight to 0.25% by weight, from 0.1% by weight to 0.2% by weight, from 0.1% by weight to 0.15% by weight, from 0.1% by weight to 0.14% by weight, from 0.1% by weight to 0.12% by weight, from 0.1% by weight to 0.15% by weight, from 0.12% by weight to 0.14% by weight, from 0.12% by weight to 0.14% by weight, or from 0.14% by weight to 0.15% by weight).

Additional additives can be included in the aluminum alloy such as zinc, boron, titanium, chromium, tin, or nickel. Suitable additives are commonly known.

Methods of Making

Also described are methods of forming an aluminum alloy, the method comprising: combining a secondary aluminum alloy with manganese to form the aluminum alloy; and cooling the aluminum alloy.

The secondary aluminum alloy can be any commercially available secondary aluminum alloy with an amount of iron ranging from 0.3% by weight to 1% by weight, based on the total weight of the secondary aluminum alloy. In some embodiments, the iron can be present in the secondary aluminum alloy in an amount greater than or equal to 0.3% by weight, based on the total weight of the secondary aluminum alloy (e.g., greater than or equal to 0.4% by weight, greater than or equal to 0.5% by weight, greater than or equal to 0.6% by weight, greater than or equal to 0.7% by weight, greater than or equal to 0.8% by weight, or greater than or equal to 0.9% by weight). In some embodiments, the iron can be present in an amount of 1% by weight or less, based on the total weight of the secondary aluminum alloy (e.g., 0.9% by weight or less, 0.8% by weight or less, 0.7% by weight or less, 0.6% by weight or less, 0.5% by weight or less, or 0.4% by weight or less). The iron can be present in an amount ranging from any of the minimum values described above to any of the maximum values described above. For example, in some embodiments, the iron is present in an amount ranging from 0.3% by weight to 1% by weight, based on the total weight of the secondary aluminum alloy, (e.g., from 0.3% by weight to 0.9% by weight, from 0.3% by weight to 0.8% by weight, from 0.3% by weight to 0.7% by weight, from 0.3% by weight to 0.6% by weight, from 0.3% by weight to 0.5% by weight, from 0.3% by weight to 0.4% by weight, from 0.4% by weight to 1% by weight, from 0.4% by weight to 0.9% by weight, from 0.4% by weight to 0.8% by weight, from 0.4% by weight to 0.7% by weight, from 0.4% by weight to 0.6% by weight, from 0.4% by weight to 0.5% by weight, from 0.5% by weight to 1% by weight, from 0.5% by weight to 0.9% by weight, from 0.5% by weight to 0.8% by weight, from 0.5% by weight to 0.7% by weight, from 0.5% by weight to 0.6% by weight, from 0.6% by weight to 1% by weight, from 0.6% by weight to 0.9% by weight, from 0.6% by weight to 0.8% by weight, from 0.6% by weight to 0.7% by weight, from 0.7% by weight to 1% by weight, from 0.7% by weight to 0.9% by weight, from 0.7% by weight to 0.8% by weight, from 0.8% by weight to 1% by weight, from 0.8% by weight to 0.9% by weight, or from 0.9% by weight to 1% by weight).

In some embodiments, the manganese can be combined with the secondary aluminum alloy in an amount of at least 0.1% by weight, based on the total weight of the aluminum alloy (e.g., at least 0.2% by weight, at least 0.3% by weight, at least 0.4% by weight, at least 0.5% by weight, at least 0.6% by weight, at least 0.7% by weight, at least 0.8% by weight, at least 0.9% by weight, at least 1% by weight, at least 1.1% by weight, or at least 1.2% by weight). In some embodiments, the manganese can be combined with the secondary aluminum alloy in an amount of 1.3% by weight or less, based on the total weight of the aluminum alloy (e.g., 1.2% by weight or less, 1.1% by weight or less, 1% by weight or less, 0.9% by weight or less, 0.8% by weight or less, 0.7% by weight or less, 0.6% by weight or less, 0.5% by weight or less, 0.4% by weight or less, 0.3% by weight or less, 0.2% by weight or less). The manganese can be combined with the secondary aluminum alloy in an amount ranging from any of the minimum values described above to any of the maximum values described above. For example, in some embodiments, the manganese can be combined with the secondary aluminum alloy in an amount ranging from 0.1% by weight to 1.3% by weight, based on the total weight of the aluminum alloy (e.g., from 0.1% by weight to 1.2% by weight, from 0.1% by weight to 1.1% by weight, from 0.1% by weight to 1% by weight, from 0.1% by weight to 0.9% by weight, from 0.1% by weight to 0.8% by weight, from 0.1% by weight to 0.7% by weight, from 0.1% by weight to 0.6% by weight, from 0.1% by weight to 0.5% by weight, from 0.1% by weight to 0.4% by weight, from 0.1% by weight to 0.3% by weight, from 0.1% by weight to 0.2% by weight, from 0.25% by weight to 1.2% by weight, from 0.25% by weight to 1.1% by weight, from 0.25% by weight to 1% by weight, from 0.25% by weight to 0.9% by weight, from 0.25% by weight to 0.8% by weight, from 0.25% by weight to 0.7% by weight, from 0.25% by weight to 0.6% by weight, from 0.25% by weight to 0.5% by weight, from 0.25% by weight to 0.4% by weight, from 0.25% by weight to 0.3% by weight, from 0.3% by weight to 1.2% by weight, from 0.3% by weight to 1.1% by weight, from 0.3% by weight to 1% by weight, from 0.3% by weight to 0.9% by weight, from 0.3% by weight to 0.8% by weight, from 0.3% by weight to 0.7% by weight, from 0.3% by weight to 0.6% by weight, from 0.3% by weight to 0.5% by weight, from 0.3% by weight to 0.4% by weight, from 0.4% by weight to 1.2% by weight, from 0.4% by weight to 1.1% by weight, from 0.4% by weight to 1% by weight, from 0.4% by weight to 0.9% by weight, from 0.4% by weight to 0.8% by weight, from 0.4% by weight to 0.7% by weight, from 0.4% by weight to 0.6% by weight, from 0.4% by weight to 0.5% by weight, from 0.5% by weight to 1.2% by weight, from 0.5% by weight to 1.1% by weight, from 0.5% by weight to 1% by weight, from 0.5% by weight to 0.9% by weight, from 0.5% by weight to 0.8% by weight, from 0.5% by weight to 0.7% by weight, from 0.5% by weight to 0.6% by weight, from 0.6% by weight to 1.2% by weight, from 0.6% by weight to 1.1% by weight, from 0.6% by weight to 1% by weight, from 0.6% by weight to 0.9% by weight, from 0.6% by weight to 0.8% by weight, from 0.6% by weight to 0.7% by weight, from 0.7% by weight to 1.2% by weight, from 0.7% by weight to 1.1% by weight, from 0.7% by weight to 1% by weight, from 0.7% by weight to 0.9% by weight, from 0.7% by weight to 0.8% by weight, from 0.1% by weight to 1.2% by weight, from 0.1% by weight to 1.1% by weight, from 0.8% by weight to 1% by weight, from 0.8% by weight to 0.9% by weight, from 0.9% by weight to 1.2% by weight, from 0.9% by weight to 1.1% by weight, from 0.9% by weight to 1% by weight, from 1% by weight to 1.2% by weight, from 1% by weight to 1.1% by weight, from 1.1% by weight to 1.3% by weight, from 1.1% by weight to 1.2% by weight, from 0.2% by weight to 1.3% by weight, from 0.3% by weight to 1.3% by weight, from 0.4% by weight to 1.3% by weight, from 0.5% by weight to 1.3% by weight, from 0.6% by weight to 1.3% by weight, from 0.7% by weight to 1.3% by weight, from 0.8% by weight to 1.3% by weight, from 0.9% by weight to 1.3% by weight, or from 1% by weight to 1.3% by weight).

In some embodiments, the secondary aluminum alloy can be combined with manganese in a ratio of iron to manganese of at least 0.6:1 (e.g., at least 0.65:1, at least 0.7:1, at least 0.75:1, at least 0.8:1, at least 0.85:1, at least 0.9:1, or at least 0.95:1). In some embodiments, the secondary aluminum alloy can be combined with manganese in a ratio of iron to manganese of 1:1 or less (e.g., 0.95:1 or less, 0.9:1 or less, 0.85:1 or less, 0.8:1 or less, 0.75:1 or less, or 0.7:1 or less). The secondary aluminum alloy can be combined with manganese in a ratio of iron to manganese from any of the minimum values described above to any of the maximum values described above. For example, in some embodiments, the secondary aluminum alloy can be combined with manganese in a ratio of iron to manganese ranging from 0.6:1 to 1:1, (e.g., from 0.6:1 to 0.9:1, from 0.6:1 to 0.8:1, from 0.6:1 to 0.7:1, from 0.7:1 to 0.8:1, from 0.7:1 to 0.9:1, from 0.7:1 to 1:1, from 0.8:1 to 0.9:1, from 0.8:1 to 1:1, or from 0.9:1 to 1:1).

In some embodiments, the secondary aluminum alloy can be combined with manganese in a ratio of iron to manganese of at least 1.6:1 (e.g., at least 1.7:1, at least 1.8:1, at least 1.9:1, at least 2:1, at least 2.1:1, at least 2.2:1, at least 2.3:1, at least 2.4:1, or at least 2.5:1). In some embodiments, the secondary aluminum alloy can be combined with manganese in a ratio of iron to manganese of 2.6:1 or less (e.g., 2.5:1 or less, 2.4:1 or less, 2.3:1 or less, 2.2:1 or less, 2.1:1 or less, 2:1 or less, 1.9:1 or less, 1.8:1 or less, or 1.7:1 or less). The secondary aluminum alloy can be combined with manganese in a ratio of iron to manganese from any of the minimum values described above to any of the maximum values described above. For example, in some embodiments, the secondary aluminum alloy can be combined with manganese in a ratio of iron to manganese ranging from 1.6:1 to 2.6:1, such as from 1.7:1 to 2.6:1, from 1.8:1 to 2.6:1, from 1.9:1 to 2.6:1, from 2:1 to 2.6:1, from 2.2:1 to 2.6:1, from 2.3:1 to 2.6:1, from 2.4:1 to 2.6:1, from 2.5:1 to 2.6:1, from 1.6:1 to 2.5:1, from 1.7:1 to 2.5:1, from 1.8:1 to 2.5:1, from 1.9:1 to 2.5:1, from 2:1 to 2.5:1, from 2.2:1 to 2.5:1, from 2.3:1 to 2.5:1, from 1.6:1 to 2.4:1, from 1.7:1 to 2.4:1, from 1.8:1 to 2.4:1, from 1.9:1 to 2.4:1, from 2:1 to 2.4:1, from 2.2:1 to 2.4:1, from 2.3:1 to 2.4:1, from 1.6:1 to 2.3:1, from 1.7:1 to 2.3:1, from 1.8:1 to 2.3:1, from 1.9:1 to 2.3:1, from 2:1 to 2.3:1, from 2.2:1 to 2.3:1, 1.6:1 to 2.2:1, from 1.7:1 to 2.2:1, from 1.8:1 to 2.2:1, from 1.9:1 to 2.2:1, from 2:1 to 2.2:1, from 1.6:1 to 2.1:1, from 1.7:1 to 2.1:1, from 1.8:1 to 2.1:1, from 1.9:1 to 2.1:1, from 2:1 to 2.1:1, from 1.6:1 to 2:1, from 1.7:1 to 2:1, from 1.8:1 to 2:1, from 1.9:1 to 2:1, from 1.6:1 to 1.9:1, from 1.7:1 to 1.9:1, from 1.8:1 to 1.9:1, from 1.6:1 to 1.8:1, from 1.7:1 to 1.8:1, or from 1.6:1 to 1.7:1.

In some embodiments, the cooling step comprises cooling the aluminum alloy at a cooling rate ranging from 0.1° C./s to 4° C./s, such as from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2° C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s.

In some embodiments, the cooling step comprises cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10° C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

In some embodiments, when the secondary aluminum alloy is combined with manganese in a ratio of iron to manganese of at least 0.6:1 (e.g., at least 0.65:1, at least 0.7:1, at least 0.75:1, at least 0.8:1, at least 0.85:1, at least 0.9:1, or at least 0.95:1), the cooling step can include cooling the aluminum alloy at a cooling rate ranging from 0.1° C./s to 4° C./s (e.g., from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2° C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s).

In some embodiments, when the secondary aluminum alloy is combined with manganese in a ratio of iron to manganese of 1:1 or less (e.g., 0.95:1 or less, 0.9:1 or less, 0.85:1 or less, 0.8:1 or less, 0.75:1 or less, or 0.7:1 or less), the cooling step can include cooling the aluminum alloy at a cooling rate ranging from 0.1° C./s to 4° C./s (e.g., from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2° C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s).

In some embodiments, when the secondary aluminum alloy is combined with manganese in a ratio of iron to manganese from any of the minimum values described above to any of the maximum values described above, for example, when the secondary aluminum alloy is combined with manganese in a ratio of iron to manganese ranging from 0.6:1 to 1:1 (e.g., from 0.6:1 to 0.9:1, from 0.6:1 to 0.8:1, from 0.6:1 to 0.7:1, from 0.7:1 to 0.8:1, from 0.7:1 to 0.9:1, from 0.7:1 to 1:1, from 0.8:1 to 0.9:1, from 0.8:1 to 1:1, or from 0.9:1 to 1:1), the cooling step can include cooling the aluminum alloy at a cooling rate ranging 0.1° C./s to 4° C./s, such as from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2° C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s.

In some embodiments, when the secondary aluminum alloy is combined with manganese in a ratio of iron to manganese of at least 1.6:1 (e.g., at least 1.7:1, at least 1.8:1, at least 1.9:1, at least 2:1, at least 2.1:1, at least 2.2:1, at least 2.3:1, at least 2.4:1, or at least 2.5:1), the cooling step can include cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10° C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

In some embodiments, when the secondary aluminum alloy is combined with manganese in a ratio of iron to manganese of 2.6:1 or less (e.g., 2.5:1 or less, 2.4:1 or less, 2.3:1 or less, 2.2:1 or less, 2.1:1 or less, 2:1 or less, 1.9:1 or less, 1.8:1 or less, or 1.7:1 or less), the cooling step can include cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10° C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

In some embodiments, when the secondary aluminum alloy is combined with manganese in a ratio of iron to manganese from any of the minimum values described above to any of the maximum values described above, for example, when the iron and manganese can be present in the aluminum alloy in a ratio ranging from 1.6:1 to 2.6:1, (e.g. from 1.7:1 to 2.6:1, from 1.8:1 to 2.6:1, from 1.9:1 to 2.6:1, from 2:1 to 2.6:1, from 2.2:1 to 2.6:1, from 2.3:1 to 2.6:1, from 2.4:1 to 2.6:1, from 2.5:1 to 2.6:1, from 1.6:1 to 2.5:1, from 1.7:1 to 2.5:1, from 1.8:1 to 2.5:1, from 1.9:1 to 2.5:1, from 2:1 to 2.5:1, from 2.2:1 to 2.5:1, from 2.3:1 to 2.5:1, from 1.6:1 to 2.4:1, from 1.7:1 to 2.4:1, from 1.8:1 to 2.4:1, from 1.9:1 to 2.4:1, from 2:1 to 2.4:1, from 2.2:1 to 2.4:1, from 2.3:1 to 2.4:1, from 1.6:1 to 2.3:1, from 1.7:1 to 2.3:1, from 1.8:1 to 2.3:1, from 1.9:1 to 2.3:1, from 2:1 to 2.3:1, from 2.2:1 to 2.3:1, 1.6:1 to 2.2:1, from 1.7:1 to 2.2:1, from 1.8:1 to 2.2:1, from 1.9:1 to 2.2:1, from 2:1 to 2.2:1, from 1.6:1 to 2.1:1, from 1.7:1 to 2.1:1, from 1.8:1 to 2.1:1, from 1.9:1 to 2.1:1, from 2:1 to 2.1:1, from 1.6:1 to 2:1, from 1.7:1 to 2:1, from 1.8:1 to 2:1, from 1.9:1 to 2:1, from 1.6:1 to 1.9:1, from 1.7:1 to 1.9:1, from 1.8:1 to 1.9:1, from 1.6:1 to 1.8:1, from 1.7:1 to 1.8:1, or from 1.6:1 to 1.7:1), the cooling step can include cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10° C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

The aluminum alloy can be any aluminum alloy described herein. For example, in some embodiments, the aluminum alloy can include aluminum, silicon, iron, and manganese. The manganese can be present in amount effective to suppress the formation of a $\beta$-$Al_5FeSi$ phase during casting of the aluminum alloy.

Methods of Use

Described are also methods of improving mechanical properties of a secondary aluminum alloy, the method comprising: adding manganese to the secondary aluminum alloy to form the aluminum alloy having improved mechanical properties; and cooling the aluminum alloy having improved mechanical properties.

In some embodiments, the manganese can be added to the secondary aluminum alloy in an amount of at least 0.1% by weight, based on the total weight of the aluminum alloy (e.g., at least 0.2% by weight, at least 0.3% by weight, at least 0.4% by weight, at least 0.5% by weight, at least 0.6% by weight, at least 0.7% by weight, at least 0.8% by weight, at least 0.9% by weight, at least 1% by weight, at least 1.1% by weight, or at least 1.2% by weight). In some embodiments, the manganese can be added to the secondary aluminum in an amount of 1.3% by weight or less, based on the total weight of the aluminum alloy (e.g., 1.2% by weight or less, 1.1% by weight or less, 1% by weight or less, 0.9% by weight or less, 0.8% by weight or less, 0.7% by weight or less, 0.6% by weight or less, 0.5% by weight or less, 0.4% by weight or less, 0.3% by weight or less, 0.2% by weight or less). The manganese can be added to the secondary aluminum in an amount ranging from any of the minimum values described above to any of the maximum values described above. For example, in some embodiments, the manganese can be added to the secondary aluminum in an amount ranging from 0.1% by weight to 1.3% by weight, based on the total weight of the aluminum alloy (e.g., from 0.1% by weight to 1.2% by weight, from 0.1% by weight to 1.1% by weight, from 0.1% by weight to 1% by weight, from 0.1% by weight to 0.9% by weight, from 0.1% by weight to 0.8% by weight, from 0.1% by weight to 0.7% by weight, from 0.1% by weight to 0.6% by weight, from 0.1% by weight to 0.5% by weight, from 0.1% by weight to 0.4% by weight, from 0.1% by weight to 0.3% by weight, from 0.1% by weight to 0.2% by weight, from 0.25% by weight to 1.2% by weight, from 0.25% by weight to 1.1% by weight, from 0.25% by weight to 1% by weight, from 0.25% by weight to 0.9% by weight, from 0.25% by weight to 0.8% by weight, from 0.25% by weight to 0.7% by weight, from 0.25% by weight to 0.6% by weight, from 0.25% by weight to 0.5% by weight, from 0.25% by weight to 0.4% by weight, from 0.25% by weight to 0.3% by weight, from 0.3% by weight to 1.2% by weight, from 0.3% by weight to 1.1% by weight, from 0.3% by weight to 1% by weight, from 0.3% by weight to 0.9% by weight, from 0.3% by weight to 0.8% by weight, from 0.3% by weight to 0.7% by weight, from 0.3% by weight to 0.6% by weight, from 0.3% by weight to 0.5% by weight, from 0.3% by weight to 0.4% by weight, from 0.4% by weight to 1.2% by weight, from 0.4% by weight to 1.1% by weight, from 0.4% by weight to 1% by weight, from 0.4% by weight to 0.9% by weight, from 0.4% by weight to 0.8% by weight, from 0.4% by weight to 0.7% by weight, from 0.4% by weight to 0.6% by weight, from 0.4% by weight to 0.5% by weight, from 0.5% by weight to 1.2% by weight, from 0.5% by weight to 1.1% by weight, from 0.5% by weight to 1% by weight, from 0.5% by weight to 0.9% by weight, from 0.5% by weight to 0.8% by weight, from 0.5% by weight to 0.7% by weight, from 0.5% by weight to 0.6% by weight, from 0.6% by weight to 1.2% by weight, from 0.6% by weight to 1.1% by weight, from 0.6% by weight to 1% by weight, from 0.6% by weight to 0.9% by weight, from 0.6% by weight to 0.8% by weight, from 0.6% by weight to 0.7% by weight, from 0.7% by weight to 1.2% by weight, from 0.7% by weight to 1.1% by weight, from 0.7% by weight to 1% by weight, from 0.7% by weight to 0.9% by weight, from 0.7% by weight to 0.8% by weight, from 0.1% by weight to 1.2% by weight, from 0.1% by weight to 1.1% by weight, from 0.8% by weight to 1% by weight, from 0.8% by weight to 0.9% by weight, from 0.9% by weight to 1.2% by weight, from 0.9% by weight to 1.1% by weight, from 0.9% by weight to 1% by weight, from 1% by weight to 1.2% by weight, from 1% by weight to 1.1% by weight, from 1.1% by weight to 1.3% by weight, from 1.1% by weight to 1.2% by weight, from 0.2% by weight to 1.3% by weight, from 0.3% by weight to 1.3% by weight, from 0.4% by weight to 1.3% by weight, from 0.5% by weight to 1.3% by weight, from 0.6% by weight to 1.3% by weight, from 0.7% by weight to 1.3% by weight, from 0.8% by weight to 1.3% by weight, from 0.9% by weight to 1.3% by weight, or from 1% by weight to 1.3% by weight).

The secondary aluminum alloy can be any commercially available secondary aluminum alloy including an amount of iron ranging from 0.3% by weight to 1% by weight, based on the total weight of the secondary aluminum alloy. In some embodiments, the iron in the secondary aluminum alloy can be present in an amount greater than or equal to 0.3% by weight, based on the total weight of the secondary aluminum alloy (e.g., greater than or equal to 0.4% by weight, greater than or equal to 0.5% by weight, greater than or equal to 0.6% by weight, greater than or equal to 0.7% by weight, greater than or equal to 0.8% by weight, or greater than or equal to 0.9% by weight). In some embodiments, the iron in the secondary aluminum alloy can be present in an amount of 1% by weight or less, based on the total weight of the secondary aluminum alloy (e.g., 0.9% by weight or less, 0.8% by weight or less, 0.7% by weight or less, 0.6% by weight or less, 0.5% by weight or less, or 0.4% by weight or less). The iron can be present in an amount ranging from any of the minimum values described above to any of the maximum values described above. For example, in some embodiments, the iron is present in an amount ranging from 0.3% by weight to 1% by weight, based on the total weight of the secondary aluminum alloy, (e.g., from 0.3% by weight to 0.9% by weight, from 0.3% by weight to 0.8% by weight, from 0.3% by weight to 0.7% by weight, from 0.3% by weight to 0.6% by weight, from 0.3% by weight to 0.5% by weight, from 0.3% by weight to 0.4% by weight, from 0.4% by weight to 1% by weight, from 0.4% by weight to 0.9% by weight, from 0.4% by weight to 0.8% by weight, from 0.4% by weight to 0.7% by weight, from 0.4% by weight to 0.6% by weight, from 0.4% by weight to 0.5% by weight, from 0.5% by weight to 1% by weight, from 0.5% by weight to 0.9% by weight, from 0.5% by weight to 0.8% by weight, from 0.5% by weight to 0.7% by weight, from 0.5% by weight to 0.6% by weight, from 0.6% by weight to 1% by weight, from 0.6% by weight to 0.9% by weight, from 0.6% by weight to 0.8% by weight, from 0.6% by weight to 0.7% by weight, from 0.7% by weight to 1% by weight, from 0.7% by weight to 0.9% by weight, from 0.7% by weight to 0.8% by weight, from 0.8% by weight to 1% by weight, from 0.8% by weight to 0.9% by weight, or from 0.9% by weight to 1% by weight).

In some embodiments, the manganese can be added to the secondary aluminum alloy in a ratio of iron to manganese of at least 0.6:1 (e.g., at least 0.65:1, at least 0.7:1, at least 0.75:1, at least 0.8:1, at least 0.85:1, at least 0.9:1, or at least 0.95:1). In some embodiments, the manganese can be added to the secondary aluminum alloy in a ratio of iron to manganese of 1:1 or less (e.g., 0.95:1 or less, 0.9:1 or less, 0.85:1 or less, 0.8:1 or less, 0.75:1 or less, or 0.7:1 or less). The manganese can be added to the secondary aluminum alloy in a ratio of iron to manganese from any of the minimum values described above to any of the maximum values described above. For example, in some embodiments, the manganese can be added to the secondary aluminum alloy in a ratio of iron to manganese ranging from 0.6:1 to 1:1, (e.g., from 0.6:1 to 0.9:1, from 0.6:1 to 0.8:1, from 0.6:1 to 0.7:1, from 0.7:1 to 0.8:1, from 0.7:1 to 0.9:1, from 0.7:1 to 1:1, from 0.8:1 to 0.9:1, from 0.8:1 to 1:1, or from 0.9:1 to 1:1).

In some embodiments, the manganese can be added to the secondary aluminum alloy in a ratio of iron to manganese of at least 1.6:1 (e.g., at least 1.7:1, at least 1.8:1, at least 1.9:1, at least 2:1, at least 2.1:1, at least 2.2:1, at least 2.3:1, at least 2.4:1, or at least 2.5:1). In some embodiments, the manganese can be added to the secondary aluminum alloy in a ratio of iron to manganese of 2.6:1 or less (e.g., 2.5:1 or less, 2.4:1 or less, 2.3:1 or less, 2.2:1 or less, 2.1:1 or less, 2:1 or less, 1.9:1 or less, 1.8:1 or less, or 1.7:1 or less). The manganese can be added to the secondary aluminum alloy in a ratio of iron to manganese from any of the minimum values described above to any of the maximum values described above. For example, in some embodiments, the manganese can be added to the secondary aluminum alloy in a ratio of iron to manganese ranging from 1.6:1 to 2.6:1, such as from 1.7:1 to 2.6:1, from 1.8:1 to 2.6:1, from 1.9:1 to 2.6:1, from 2:1 to 2.6:1, from 2.2:1 to 2.6:1, from 2.3:1 to 2.6:1, from 2.4:1 to 2.6:1, from 2.5:1 to 2.6:1, from 1.6:1 to 2.5:1, from 1.7:1 to 2.5:1, from 1.8:1 to 2.5:1, from 1.9:1 to 2.5:1, from 2:1 to 2.5:1, from 2.2:1 to 2.5:1, from 2.3:1 to 2.5:1, from 1.6:1 to 2.4:1, from 1.7:1 to 2.4:1, from 1.8:1 to 2.4:1, from 1.9:1 to 2.4:1, from 2:1 to 2.4:1, from 2.2:1 to 2.4:1, from 2.3:1 to 2.4:1, from 1.6:1 to 2.3:1, from 1.7:1 to 2.3:1, from 1.8:1 to 2.3:1, from 1.9:1 to 2.3:1, from 2:1 to 2.3:1, from 2.2:1 to 2.3:1, 1.6:1 to 2.2:1, from 1.7:1 to 2.2:1, from 1.8:1 to 2.2:1, from 1.9:1 to 2.2:1, from 2:1 to 2.2:1, from 1.6:1 to 2.1:1, from 1.7:1 to 2.1:1, from 1.8:1 to 2.1:1, from 1.9:1 to 2.1:1, from 2:1 to 2.1:1, from 1.6:1 to 2:1, from 1.7:1 to 2:1, from 1.8:1 to 2:1, from 1.9:1 to 2:1, from 1.6:1 to 1.9:1, from 1.7:1 to 1.9:1, from 1.8:1 to 1.9:1, from 1.6:1 to 1.8:1, from 1.7:1 to 1.8:1, or from 1.6:1 to 1.7:1.

In some embodiments, the cooling step comprises cooling the aluminum alloy at a cooling rate ranging from 0.1° C./s to 4° C./s, such as from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2° C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s.

In some embodiments, the cooling step comprises cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10° C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

In some embodiments, when manganese is added to the secondary aluminum alloy in a ratio of iron to manganese of at least 0.6:1 (e.g., at least 0.65:1, at least 0.7:1, at least 0.75:1, at least 0.8:1, at least 0.85:1, at least 0.9:1, or at least 0.95:1), the cooling step can include cooling the aluminum alloy at a cooling rate ranging from 0.1° C./s to 4° C./s (e.g., from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2°

C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s).

In some embodiments, when manganese is added to the secondary aluminum alloy in a ratio of iron to manganese of 1:1 or less (e.g., 0.95:1 or less, 0.9:1 or less, 0.85:1 or less, 0.8:1 or less, 0.75:1 or less, or 0.7:1 or less), the cooling step can include cooling the aluminum alloy at a cooling rate ranging from 0.1° C./s to 4° C./s (e.g., from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2° C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s).

In some embodiments, when manganese is added to the secondary aluminum alloy in a ratio of iron to manganese from any of the minimum values described above to any of the maximum values described above, for example, when manganese is added to the secondary aluminum alloy in a ratio of iron to manganese ranging from 0.6:1 to 1:1 (e.g., from 0.6:1 to 0.9:1, from 0.6:1 to 0.8:1, from 0.6:1 to 0.7:1, from 0.7:1 to 0.8:1, from 0.7:1 to 0.9:1, from 0.7:1 to 1:1, from 0.8:1 to 0.9:1, from 0.8:1 to 1:1, or from 0.9:1 to 1:1), the cooling step can include cooling the aluminum alloy at a cooling rate ranging 0.1° C./s to 4° C./s, such as from 0.1° C./s to 3° C./s, from 0.1° C./s to 2° C./s, from 0.1° C./s to 1° C./s, from 0.1° C./s to 0.5° C./s, from 0.5° C./s to 4° C./s, from 0.5° C./s to 3° C./s, from 0.5° C./s to 2° C./s, from 0.5° C./s to 1° C./s, from 1° C./s to 4° C./s, from 1° C./s to 3° C./s, from 1° C./s to 2° C./s, from 1.5° C./s to 3° C./s, from 1.5° C./s to 4° C./s, from 1.5° C./s to 2° C./s, from 2° C./s to 2.5° C./s, from 2° C./s to 3° C./s, from 2° C./s to 4° C./s, from 2.5° C./s to 3° C./s, from 2.5° C./s to 4° C./s, from 3° C./s to 4° C./s, or from 3.5° C./s to 4° C./s.

In some embodiments, when manganese is added to the secondary aluminum alloy in a ratio of iron to manganese of at least 1.6:1 (e.g., at least 1.7:1, at least 1.8:1, at least 1.9:1, at least 2:1, at least 2.1:1, at least 2.2:1, at least 2.3:1, at least 2.4:1, or at least 2.5:1), the cooling step can include cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10° C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

In some embodiments, when manganese is added to the secondary aluminum alloy in a ratio of iron to manganese of 2.6:1 or less (e.g., 2.5:1 or less, 2.4:1 or less, 2.3:1 or less, 2.2:1 or less, 2.1:1 or less, 2:1 or less, 1.9:1 or less, 1.8:1 or less, or 1.7:1 or less), the cooling step can include cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10° C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

In some embodiments, when manganese is added to the secondary aluminum alloy in a ratio of iron to manganese from any of the minimum values described above to any of the maximum values described above, for example, when manganese is added to the secondary aluminum alloy in a ratio of iron to manganese from 1.6:1 to 2.6:1, (e.g. from 1.7:1 to 2.6:1, from 1.8:1 to 2.6:1, from 1.9:1 to 2.6:1, from 2:1 to 2.6:1, from 2.2:1 to 2.6:1, from 2.3:1 to 2.6:1, from 2.4:1 to 2.6:1, from 2.5:1 to 2.6:1, from 1.6:1 to 2.5:1, from 1.7:1 to 2.5:1, from 1.8:1 to 2.5:1, from 1.9:1 to 2.5:1, from 2:1 to 2.5:1, from 2.2:1 to 2.5:1, from 2.3:1 to 2.5:1, from 1.6:1 to 2.4:1, from 1.7:1 to 2.4:1, from 1.8:1 to 2.4:1, from 1.9:1 to 2.4:1, from 2:1 to 2.4:1, from 2.2:1 to 2.4:1, from 2.3:1 to 2.4:1, from 1.6:1 to 2.3:1, from 1.7:1 to 2.3:1, from 1.8:1 to 2.3:1, from 1.9:1 to 2.3:1, from 2:1 to 2.3:1, from 2.2:1 to 2.3:1, 1.6:1 to 2.2:1, from 1.7:1 to 2.2:1, from 1.8:1 to 2.2:1, from 1.9:1 to 2.2:1, from 2:1 to 2.2:1, from 1.6:1 to 2.1:1, from 1.7:1 to 2.1:1, from 1.8:1 to 2.1:1, from 1.9:1 to 2.1:1, from 2:1 to 2.1:1, from 1.6:1 to 2:1, from 1.7:1 to 2:1, from 1.8:1 to 2:1, from 1.9:1 to 2:1, from 1.6:1 to 1.9:1, from 1.7:1 to 1.9:1, from 1.8:1 to 1.9:1, from 1.6:1 to 1.8:1, from 1.7:1 to 1.8:1, or from 1.6:1 to 1.7:1), the cooling step can include cooling the aluminum alloy at a cooling rate ranging from 3° C./s to 500° C./s, (e.g. from 3° C./s to 5° C./s, 3° C./s to 10° C./s, 3° C./s to 15° C./s, 3° C./s to 20° C./s, 3° C./s to 25° C./s, 3° C./s to 30° C./s, 3° C./s to 40° C./s, 3° C./s to 50° C./s, 3° C./s to 60° C./s, 3° C./s to 70° C./s, 3° C./s to 80° C./s, 3° C./s to 90° C./s, 3° C./s to 100° C./s, 3° C./s to 150° C./s, 3° C./s to 200° C./s, 3° C./s to 250° C./s, 3° C./s to 300° C./s, 3° C./s to 350° C./s, 3° C./s to 400° C./s, 3° C./s to 450° C./s, 5° C./s to 10° C./s, 5° C./s to 15° C./s, 5° C./s to 20° C./s, 5° C./s to 25° C./s, 5° C./s to 30° C./s, 5° C./s to 40° C./s, 5° C./s to 50° C./s, 5° C./s to 60° C./s, 5° C./s to 70° C./s, 5° C./s to 80° C./s, 5° C./s to 90° C./s, 5° C./s to 100° C./s, 5° C./s to 150° C./s, 5° C./s to 200° C./s, 5° C./s to 250° C./s, 5° C./s to 300° C./s, 5° C./s to 350° C./s, 5° C./s to 400° C./s, 5° C./s to 450° C./s, 5° C./s to 500° C./s, 10° C./s to 15° C./s, 10° C./s to 20° C./s, 10° C./s to 25° C./s, 10°

C./s to 30° C./s, 10° C./s to 40° C./s, 10° C./s to 50° C./s, 10° C./s to 60° C./s, 10° C./s to 70° C./s, 10° C./s to 80° C./s, 10° C./s to 90° C./s, 10° C./s to 100° C./s, 10° C./s to 150° C./s, 10° C./s to 200° C./s, 10° C./s to 250° C./s, 10° C./s to 300° C./s, 10° C./s to 350° C./s, 10° C./s to 400° C./s, 10° C./s to 450° C./s, 10° C./s to 500° C./s, 11° C./s to 15° C./s, 11° C./s to 20° C./s, 11° C./s to 25° C./s, 11° C./s to 30° C./s, 11° C./s to 40° C./s, 11° C./s to 50° C./s, 11° C./s to 60° C./s, 11° C./s to 70° C./s, 11° C./s to 80° C./s, 11° C./s to 90° C./s, 11° C./s to 100° C./s, 11° C./s to 150° C./s, 11° C./s to 200° C./s, 11° C./s to 250° C./s, 11° C./s to 300° C./s, 11° C./s to 350° C./s, 11° C./s to 400° C./s, 11° C./s to 450° C./s, 11° C./s to 500° C./s, 15° C./s to 20° C./s, 15° C./s to 25° C./s, 15° C./s to 30° C./s, 15° C./s to 40° C./s, 15° C./s to 50° C./s, 15° C./s to 60° C./s, 15° C./s to 70° C./s, 15° C./s to 80° C./s, 15° C./s to 90° C./s, 15° C./s to 100° C./s, 15° C./s to 150° C./s, 15° C./s to 200° C./s, 15° C./s to 250° C./s, 15° C./s to 300° C./s, 15° C./s to 350° C./s, 15° C./s to 400° C./s, 15° C./s to 450° C./s, 15° C./s to 500° C./s, 20° C./s to 25° C./s, 20° C./s to 30° C./s, 20° C./s to 40° C./s, 20° C./s to 50° C./s, 20° C./s to 60° C./s, 20° C./s to 70° C./s, 20° C./s to 80° C./s, 20° C./s to 90° C./s, 20° C./s to 100° C./s, 20° C./s to 150° C./s, 20° C./s to 200° C./s, 20° C./s to 250° C./s, 20° C./s to 300° C./s, 20° C./s to 350° C./s, 20° C./s to 400° C./s, 20° C./s to 450° C./s, 20° C./s to 500° C./s, 25° C./s to 30° C./s, 25° C./s to 40° C./s, 25° C./s to 50° C./s, 25° C./s to 60° C./s, 25° C./s to 70° C./s, 25° C./s to 80° C./s, 25° C./s to 90° C./s, 25° C./s to 100° C./s, 25° C./s to 150° C./s, 25° C./s to 200° C./s, 25° C./s to 250° C./s, 25° C./s to 300° C./s, 25° C./s to 350° C./s, 25° C./s to 400° C./s, 25° C./s to 450° C./s, 25° C./s to 500° C./s, 30° C./s to 40° C./s, 30° C./s to 50° C./s, 30° C./s to 60° C./s, 30° C./s to 70° C./s, 30° C./s to 80° C./s, 30° C./s to 90° C./s, 30° C./s to 100° C./s, 30° C./s to 150° C./s, 30° C./s to 200° C./s, 30° C./s to 250° C./s, 30° C./s to 300° C./s, 30° C./s to 350° C./s, 30° C./s to 400° C./s, 30° C./s to 450° C./s, 30° C./s to 500° C./s, 40° C./s to 50° C./s, 40° C./s to 60° C./s, 40° C./s to 70° C./s, 40° C./s to 80° C./s, 40° C./s to 90° C./s, 40° C./s to 100° C./s, 40° C./s to 150° C./s, 40° C./s to 200° C./s, 40° C./s to 250° C./s, 40° C./s to 300° C./s, 40° C./s to 350° C./s, 40° C./s to 400° C./s, 40° C./s to 450° C./s, 40° C./s to 500° C./s, 50° C./s to 60° C./s, 50° C./s to 70° C./s, 50° C./s to 80° C./s, 50° C./s to 90° C./s, 50° C./s to 100° C./s, 50° C./s to 150° C./s, 50° C./s to 200° C./s, 50° C./s to 250° C./s, 50° C./s to 300° C./s, 50° C./s to 350° C./s, 50° C./s to 400° C./s, 50° C./s to 450° C./s, 50° C./s to 500° C./s, 60° C./s to 70° C./s, 60° C./s to 80° C./s, 60° C./s to 90° C./s, 60° C./s to 100° C./s, 60° C./s to 150° C./s, 60° C./s to 200° C./s, 60° C./s to 250° C./s, 60° C./s to 300° C./s, 60° C./s to 350° C./s, 60° C./s to 400° C./s, 60° C./s to 450° C./s, 60° C./s to 500° C./s, 70° C./s to 80° C./s, 70° C./s to 90° C./s, 70° C./s to 100° C./s, 70° C./s to 150° C./s, 70° C./s to 200° C./s, 70° C./s to 250° C./s, 70° C./s to 300° C./s, 70° C./s to 350° C./s, 70° C./s to 400° C./s, 70° C./s to 450° C./s, 70° C./s to 500° C./s, 80° C./s to 90° C./s, 80° C./s to 100° C./s, 80° C./s to 150° C./s, 80° C./s to 200° C./s, 80° C./s to 250° C./s, 80° C./s to 300° C./s, 80° C./s to 350° C./s, 80° C./s to 400° C./s, 80° C./s to 450° C./s, 80° C./s to 500° C./s, or 90° C./s to 100° C./s, 90° C./s to 150° C./s, 90° C./s to 200° C./s, 90° C./s to 250° C./s, 90° C./s to 300° C./s, 90° C./s to 350° C./s, 90° C./s to 400° C./s, 90° C./s to 450° C./s, 90° C./s to 500° C./s, 100° C./s to 150° C./s, 100° C./s to 200° C./s, 100° C./s to 250° C./s, 100° C./s to 300° C./s, 100° C./s to 350° C./s, 100° C./s to 400° C./s, 100° C./s to 450° C./s, 100° C./s to 500° C./s, 150° C./s to 200° C./s, 150° C./s to 250° C./s, 150° C./s to 300° C./s, 150° C./s to 350° C./s, 150° C./s to 400° C./s, 150° C./s to 450° C./s, 150° C./s to 500° C./s, 200° C./s to 250° C./s, 200° C./s to 300° C./s, 200° C./s to 350° C./s, 200° C./s to 400° C./s, 200° C./s to 450° C./s, 200° C./s to 500° C./s, 250° C./s to 300° C./s, 250° C./s to 350° C./s, 250° C./s to 400° C./s, 250° C./s to 450° C./s, 250° C./s to 500° C./s, 300° C./s to 350° C./s, 300° C./s to 400° C./s, 300° C./s to 450° C./s, 300° C./s to 500° C./s, 350° C./s to 400° C./s, 350° C./s to 450° C./s, 350° C./s to 500° C./s, 400° C./s to 450° C./s, 400° C./s to 500° C./s, or 450° C./s to 500° C./s).

In some embodiments, the aluminum alloy having improved mechanical properties can be any aluminum alloy described here. For example, in some embodiments, the aluminum alloy can include aluminum, silicon, iron, and manganese. The manganese can be present in amount effective to suppress the formation of a $\beta$-$Al_5FeSi$ phase during casting of the aluminum alloy. As such, the alloys can have suitable mechanical properties for use in structural applications. The alloys can be processed into structural components all major casting processes, i.e., sand casting, permanent mold casting, and high-pressure die casting (HPDC).

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

By way of non-limiting illustration, examples of certain embodiments of the present disclosure are given below.

EXAMPLES

Figure 12:
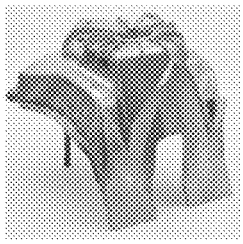
FIG. 12 shows the chemical composition of standard structural die cast aluminum alloys.

Although the world will need to increase primary production to keep up with demand, the following drivers are increasing adoption of both primary and secondary aluminum. Only 5% of the energy (and reduced emission) required to produce primary aluminum is needed to re-melt aluminum. Around 75% of the almost one billion metric tons of aluminum ever produced is still in productive use, some of it having been through countless recycle loops through its lifecycle (average lifetimes of about 15 to 20 years for vehicles and 40 to 50 years for buildings). In Europe and North America, scrap has been generated in sufficient quantities over the past 70 years to develop an economically strong and technically advanced secondary aluminum industry. Following the oil price shocks and energy cost increases of the 1970s, Japan ceased domestic primary aluminum production and switched to aluminum recycling in the 1980s. In addition to these traditional production centers, increasing recycling activities are evident in China, India, and Russia. In about 2000, the United States secondary aluminum outpaced primary aluminum production. This was due to: increased adoption of secondary aluminum, and more primary aluminum being made and imported from Canada. Now 40% of the Al in North America is Secondary. (Kevin R. Anderson, "Technical Advancements in the Secondary Aluminum Industry", Light Metals Division Luncheon, TMS Annual Meeting, San Antonio, TX, Mar. 13, 2019). Presently structural die cast aluminum alloys (such as Silafont, Aural 2 and EZCast) do not use any secondary alloys (recycled from scrap aluminum), in order to avoid the formation of brittle Fe containing intermetallic phases (leading to inferior mechanical properties) (see FIG. 12). Iron (Fe) is a major impurity element in secondary aluminum alloys (scrap) which generally contain about 1 wt. % Fe, which is difficult to be removed during melting and casting. Therefore, the current structural alloys which limit the Fe content to about 0.3% are generally more expensive for widespread applications in transportation and other industry. If lower-cost secondary aluminum alloys (generally about 30-50% cheaper than primary Al) can be used in structural die casting applications, significantly savings in cost and energy can be realized. It should be noted that the remelting and recycling process of aluminum scrap is only consuming 5% of the energy as required for primary production of aluminum. Fe-Containing Intermetallics affects mechanical properties (see J. A. Taylor, *Procedia Materials Science,* 1 (2012) 19-33, and S. Seifeddine et al., *Materials Science and Engineering: A,* 490 (2008) 385-390).

Figure 13:
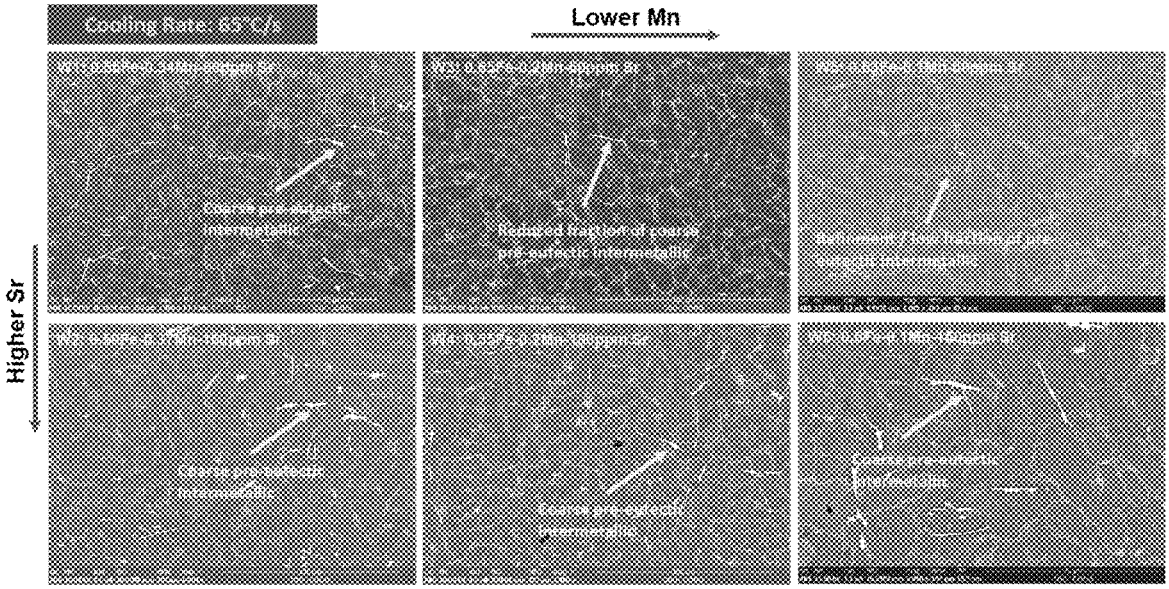
FIG. 13 shows results for the effect of Sr content on Fe-to-Mn ratio on intermetallics and eutectic microstructure. Lower Mn and Sr content yields refined intermetallic and eutectic in the microstructure.
Figure 14:
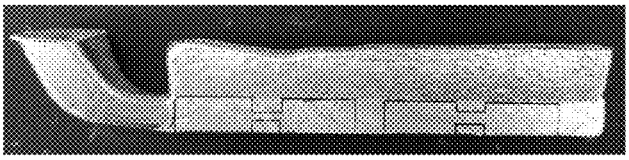
FIG. 14 shows results the mechanical properties of as-cast aluminum alloys for (approximately 50% secondary alloy) AlSiMgMn-50 ppm Sr and AlSiMgMn-100 ppm Sr.
Figure 14:
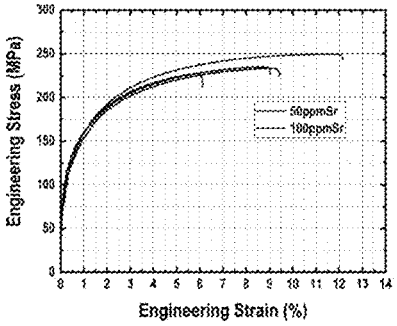

Fe-to-Mn ratio ≥1.67 can suppress β-$Al_5FeSi$ phase in as-cast microstructure at fast cooling conditions (permanent mold, high pressure die casting, etc.) for Al-(7-10)% Si-(0.3-0.5)% Mg-(0.2-1.0)% Fe-(0.2-0.6)% Mn based on experimental study. Introducing up to 50% secondary Al into structural HPDC (high pressure die cast) alloys will result in significant cost reduction (up to 0.7% Fe). For high pressure die casting (HPDC) applications: 5 to 12% Si, 0.3 to 0.5% Mn, 0.1 to 0.5% Mg, up to 0.15% Cu, 0.005 to 0.01% Sr (see FIGS. 13 and 14).

Example 1: A Formation Map of Iron-Containing Intermetallic Phases in Recycled Cast Aluminum Alloys Abstract The cooling rate-dependent modification effect of Mn on the formation of Fe-containing intermetallic phases during solidification of Al—Si—Mg secondary cast aluminum alloys [containing 0.5 to 1 pct Fe (All compositions are in wt pct unless otherwise stated.)] was investigated by CALculation of PHAse Diagrams (CALPHAD) modeling and solidification experiments. The critical Mn concentration required to prevent the formation of detrimental β-$Al_5FeSi$ was found to be dependent on both the alloy composition (particularly the Fe/Mn ratio) and the cooling rate. A map of Fe/Mn ratio vs cooling rate was created, to summarize the metallurgical conditions of Fe-rich intermetallic phase formation. By understanding such formation conditions, the microstructure of aluminum castings can be controlled to create low-cost secondary alloys with high Fe content.

Introduction

The demand for improved fuel economy and lower greenhouse gas emission without compromising passenger safety and performance has led to increased use of lightweight materials in vehicles over the last few decades.[1] Such demand has made aluminum alloys the material of choice for many automotive applications because of their lightweight, good specific strength, and exceptional corrosion resistance.[2] However, the high costs of primary aluminum production[3] and component manufacturing often limit the widespread usage of aluminum in the vehicle design.[4] To achieve further weight reduction in light vehicles while maintaining the affordability, it is essential to lower the manufacturing cost of aluminum components.

Aluminum can be recycled many times with exceptional recovery rates, where the energy required to produce secondary or recycled aluminum is only 5 pct of the energy used in the production of primary aluminum.[3] Such a reduction highlights strong economic and environmental benefits of utilizing recycled aluminum in production of parts for automotive industry.[3] Additionally, the excellent castability of aluminum alloys, especially of the Al—Si based alloys, enables the production of complex components as well as the consolidation of welded or joined subsystems into a single cast part at a lower cost.[2] Despite the promising outlook for the use of secondary aluminum, there is a cascade effect from continued recycling of aluminum, i.e., accumulation of alloying/impurity elements such as Fe, Mg, Cu, Zn, etc., due to the difficulty in removing them in the recycling process.[5,6] The result is that the properties of the recycled aluminum alloys can be significantly altered by the excess concentrations of these elements and renders the recycled material ill-suited for safety critical applications.

Of all impurity elements, Fe is considered the most detrimental, and its deleterious effect on the mechanical properties of Al—Si alloys is well known to the aluminum casting industry.[7-9] Fe can form numerous intermetallic phases, such as, θ-$Al_{13}Fe_4$, α-$Al_8Fe_2Si$, β-$Al_5FeSi$, δ-$Al_4FeSi_2$, π-$Al_8FeMg_3Si_2$, etc., when it is combined with other alloying elements. The size, morphology, and volume fraction of these Fe-containing intermetallics have a pronounced effect on the as-cast mechanical properties of Al—Si alloys. The most common and detrimental Fe-containing intermetallic observed in hypoeutectic Al—Si casting alloys is β-$Al_5FeSi$ phase which forms as interconnected thin platelets with a needle-like appearance in a polished cross-section.[10-12] The sharp tips of these platelets act as stress concentrators under loading and reduce the alloy ductility, rendering these alloys unusable for structural components. Therefore, it is imperative to prevent the formation of β-$Al_5FeSi$ in alloys used for applications where ductility is essential.[13-15]]

The formation of detrimental β-$Al_5FeSi$ phase can be suppressed in several ways. The commonly employed ones are either rapid solidification at high cooling rates to promote the formation of α-$Al_8Fe_2Si$ phase or by adding Mn to promote the formation of α-$Al_{15}(Fe,Mn)_3Si_2$ phase.[7-9,16] In addition, it was also demonstrated that the thermal history of molten alloy (i.e., superheat, holding time) can alter the solidification path and result in the formation of α-$Al_8Fe_2Si$ phase under non-equilibrium cooling conditions.[17] Both α-$Al_8Fe_2Si$ and α-$Al_{15}(Fe,Mn)_3Si_2$ can form in the so-called "Chinese-script" morphology or as compact globular particles, which are considered less detrimental to the mechanical properties.[8] The crystal structure, typical morphology, and their relative effect on ductility of Al—Si—Mg alloys of these Fe-containing intermetallics are given in FIG. 1.

The established standard to mitigate the adverse effects of Fe on the mechanical properties of cast aluminum alloys, regardless of cooling conditions, is to maintain a manganese concentration that is at least the half of the iron, if the iron content exceeds 0.45 pct.[7] However, the critical Mn content to eliminate β-$Al_5FeSi$ phase depends not only on the alloy composition but the cooling rate as well.[19,20] Several studies on the modification effect of Mn and cooling rate on Fe-containing intermetallic phases have been reported for various alloy systems.[21-23] An increased cooling rate will generally suppress the formation of β-$Al_5FeSi$ and promote the formation of non-equilibrium α-$Al_8Fe_2Si$ in coexistence of α-$Al_{15}(Fe,Mn)_3Si_2$. In general, the volume fraction of Fe-containing intermetallics must be minimal, since they are hard and brittle and negatively influence the mechanical properties of the alloy. Therefore, it is important to determine the critical Mn content which minimizes $\alpha$-$Al_{15}(Fe,Mn)_3Si_2$ phase fraction and avoids sludge formation, yet ensures the elimination of $\beta$-$Al_5FeSi$. Further, this compositional effect must be matched with the kinetics incorporated in the cooling rate effect of eliminating the $\beta$-$Al_5FeSi$.

In this study, the cooling rate-dependent Fe-to-Mn ratio critical to $\beta$-$Al_5FeSi$ phase formation in high Fe-content (0.5, 0.7, and 1.0 pct) Al—Si—Mg—Fe—Mn alloys was systematically investigated using CALculation of PHAse Diagram (CALPHAD) modeling and solidification experiments. The aim of the study was to establish a comprehensive map on the formation for Fe-containing intermetallics in recycled aluminum alloys with high Fe contents. The formation map, in which both alloy composition and cooling rate were considered, can serve as a guide to minimize the Fe-containing intermetallic formation across all major casting processes, i.e., sand casting, permanent mold casting, and high-pressure die casting (HPDC).

Materials and Methods

Thermodynamic Modeling

CALculation of PHAse Diagrams (CALPHAD) is a powerful tool that allows virtual investigation of phase equilibria and can guide the design of critical experiments for accelerated optimization of complex microstructures of multicomponent alloy systems.[24] The CALPHAD modeling of Al—Si—Mg—Fe—Mn quinary system was carried out using Pandat™ software by CompuTherm LLC. (Madison, WI). The thermodynamic descriptions of investigated phases are detailed in PanAl2018 thermodynamic and mobility database.

The effect of Mn content on the alloy microstructure was investigated under equilibrium and non-equilibrium conditions for the composition ranges of 7 to 10 pct Si, 0.3 to 0.5 pct Mg, 0.1 to 1.3 pct Mn, and 0.1 to 1.3 pct Fe. The investigated composition ranges were selected to cover most of the heat-treatable hypoeutectic Al—Si casting alloys that are used in a wide variety of casting applications.

The isopleths (vertical sections) of the Al—Si—Mg—Fe—Mn system were calculated for fixed concentrations of Si, Mg, and Fe, but Mn varied to determine the thermodynamic stability range of $\beta$-$Al_5FeSi$ phase. Based on phase equilibrium calculations, the high-throughput solidification calculations (HTSC) were performed using both Lever rule (equilibrium) and Scheil solidification (assuming complete mixing in liquid but no diffusion in solid) models to determine the critical Mn contents that can eliminate the $\beta$-$Al_5FeSi$ phase within the aforementioned compositional space, which was probed by compositional step sizes of 1, 0.1, 0.1 pct for Si, Mg, and Fe, respectively. For every combination of compositions, the Mn content was varied by 0.01 pct to determine the minimum Mn content required to suppress $\beta$-phase formation.

Materials and Melt Preparation

Target alloy compositions with various Fe-to-Mn ratios were selected based on CALPHAD calculations. Commercially pure aluminum (CP Al) and master alloys of Al-12 pct Si, Al-10 pct Fe, Al-25 pct Mn, and Al-68 pct Mg were used to prepare the alloys. The compositions of CP Al and master alloys are presented in Table I. The excess Fe that can be introduced into prepared alloys through CP Al and other master alloys was considered in the mass balance calculations of prepared alloys. The alloys were melted in graphite crucibles using an induction furnace. Alloying materials and crucibles were pre-heated in an electric resistance furnace at 200° C. for 10 minutes prior to melting. Then, the materials were heated up to 750° C. and held at this temperature for 30 minutes.

The compositional analysis on prepared alloys was performed using a SPECTROMAXx M Bench Top optical emission spectrometer (wavelength range 140 to 670 nm) to ensure that target compositions are obtained. The measured compositions of selected alloys are given in Table II.

TABLE I

Measured Chemical Composition of CommerciallyPure Aluminum and Master Alloys Used in this Study

| Master Alloy | Si | Fe | Mn | Mg | Cu | Al |
|---|---|---|---|---|---|---|
| CP Al | 0.02 | 0.04 | — | — | — | bal. |
| Al—Si | 11.8 | 0.2 | — | — | 0.03 | bal. |
| Al—Fe | 0.07 | 9.71 | 0.04 | 0.01 | 0.05 | bal. |
| Al—Mn | 0.2 | 0.2 | 24.6 | — | — | bal. |
| Al—Mg | 0.1 | 0.15 | — | 67.75 | — | bal. |

TABLE II

Measured Chemical Compositions of SelectedPrepared Alloys

| Alloy | Si | Mg | Fe | Mn | Al |
|---|---|---|---|---|---|
| Al—8Si—0.35Mg—0.5Fe—0.3Mn | 8.14 | 0.37 | 0.52 | 0.33 | bal. |
| Al—8Si—0.35Mg—0.5Fe—0.4Mn | 8.18 | 0.36 | 0.48 | 0.4 | bal. |
| Al—8Si—0.35Mg—0.5Fe—0.5Mn | 8.02 | 0.38 | 0.53 | 0.51 | bal. |
| Al—8Si—0.35Mg—0.7Fe—0.0Mn | 8.49 | 0.37 | 0.74 | 0.007 | bal. |
| Al—8Si—0.35Mg—0.7Fe—0.5Mn | 8.02 | 0.34 | 0.73 | 0.48 | bal. |
| Al—8Si—0.35Mg—0.7Fe—1.0Mn | 8.14 | 0.39 | 0.71 | 0.98 | bal. |
| Al—8Si—0.35Mg—1.0Fe—0.4Mn | 8.32 | 0.35 | 0.97 | 0.42 | bal. |
| Al—8Si—0.35Mg—1.0Fe—0.6Mn | 8.24 | 0.34 | 1.03 | 0.61 | bal. |
| Al—8Si—0.35Mg—1.0Fe—1.2Mn | 8.22 | 0.37 | 1.01 | 1.15 | bal. |

Casting Processes and Cooling Curve Analysis

After melting, alloys were cooled at different rates to test the effect of cooling-conditions on the alloy microstructure. The cooling curve analysis (CCA) or thermal analysis (TA) is used to determine critical arrest temperatures during solidification. The cooling curves were measured using ungrounded and exposed K-type thermocouples for faster response and a National Instruments NI-9217 data acquisition system which allows simultaneous data collection on four (4) channels. The cooling curves were recorded at a rate of 50 data points per second. Alloys were poured into standard cooling cups which are made of no-bake sand and equipped with a K-type thermocouple. The standard cooling cups are ideal to study microstructures that can be observed in sand castings under relatively slow cooling conditions. To investigate the effect of higher cooling rates on the Fe-to-Mn ratio and resulting microstructure, rod castings and wedge castings were produced. The dimensions of these castings and locations of thermocouples within the castings are provided in FIGS. 7 and 8 along with microstructural images obtained from these castings. The 1st and 2nd derivatives of the cooling curves were calculated to capture important arrest points, such as primary Al formation, eutectic silicon formation, Fe-containing intermetallic formation. The derivative curves were smoothed using locally estimated scatterplot smoothing (LOESS) method. The overall cooling rate at a given location was calculated based on the time difference between the start of aluminum dendrite formation (liquidus temperature) and the end of solidification (solidus temperature) as determined from the 2nd derivative of the cooling curves $((T_{liquidus}-T_{solidus})/(t_{liquidus}-t_{solidus}))$. Thus, the cooling rates were determined to be 0.4° C./s for sand cooling cup castings, ~30° C./s for rod castings and ~65° C./s, 5° C./s, 2° C./s, 1.5° C./s for selected locations in the wedge castings.

Microstructural Characterization

The microstructure of the specimens was investigated using both optical and electron microscopy. The specimens were polished following standard metallographic procedures and then selectively etched using a 0.74 pct HF solution to distinguish Fe-rich intermetallic phases in optical microscopy investigations. The microstructure characterization of the samples and compositional analysis of intermetallics were carried out using a FEI/Philips XL-30 scanning electron microscope (SEM) equipped with an energy-dispersive spectroscopy (EDS) system. The samples were re-polished with colloidal silica to remove the etched layer on the Fe-containing intermetallics for accurate compositional analysis. The back-scattered images of the samples and EDS analysis on intermetallic phases were obtained under an accelerating voltage of 15 kV.

Results and Discussion

CALPHAD Simulations

The effect of Mn content on the alloy microstructure was investigated under equilibrium and non-equilibrium conditions for the composition ranges of 7-10% Si, 0.3-0.5% Mg, 0.1-1.3% Mn, and 0.1-1.3% Fe. The Fe-to-Mn ratio critical to β-phase formation was first investigated under equilibrium conditions. To examine the thermodynamic stability range of f #-phase as a function of temperature and Mn concentration, equilibrium isopleths were calculated for varying levels of Si, Mg, and Fe. FIG. 2(*a*) shows an isopleth calculated for Al-8 pct Si-0.35 pct Mg-0.6 pct Fe, which maps the equilibrium phase constituents for different Mn concentrations within the temperature range of 25° C. to 700° C. The $\alpha$-$Al_{15}(Fe,Mn)_3Si_2$ phase becomes stable when Mn is above 0.022 pct at 566° C. A boundary separates the domain of "α-Al+Si+β-$Al_5$ FeSi+α-$Al_{15}(Fe,Mn)_3Si_2$" from "α-Al+Si+α-$Al_{15}(Fe,Mn)_3Si_2$" and intersects the solidus line (566° C.) at 0.58 pct Mn. The isopleths for different Mg and Si concentrations of the same Fe level (0.6 pct) are presented in FIGS. 2(*b*) and 2(*c*). The increase in Mg reduces the solidus temperature from 566° C. to 561° C., while the Mn concentration that bisects the solidus line slightly decreases from 0.58 to 0.576 pct as shown in FIG. 2(*b*). On the other hand, the influence of Si concentration on the solidus temperature and intersecting Mn concentration is minimal according to the equilibrium calculations (FIG. 2(*c*)). A small set of calculated equilibrium solidification paths for different levels of Fe are shown in FIGS. 2(*d*) and 2(*g*) as an example. In FIG. 2(*e*), the variation of total phase fraction of both β- and α-phases with Mn content for a fixed alloy composition of Al-8 pct Si-0.35 pct Mg-0.6 pct Fe is presented. Mn concentration of 0.59 pct is enough to inhibit the formation of #-phase under equilibrium solidification conditions for 0.6 pct Fe. A composition map was generated by plotting critical Mn contents, which are extracted through the analysis of HTC results, against the associated Fe level (FIG. 2(*f*)). The critical Fe-to-Mn ratio is determined to be ~1 for equilibrium conditions and the ratio of 1 holds valid if the Si and Mg concentrations were varied within the investigated composition range.

Figure 3A:
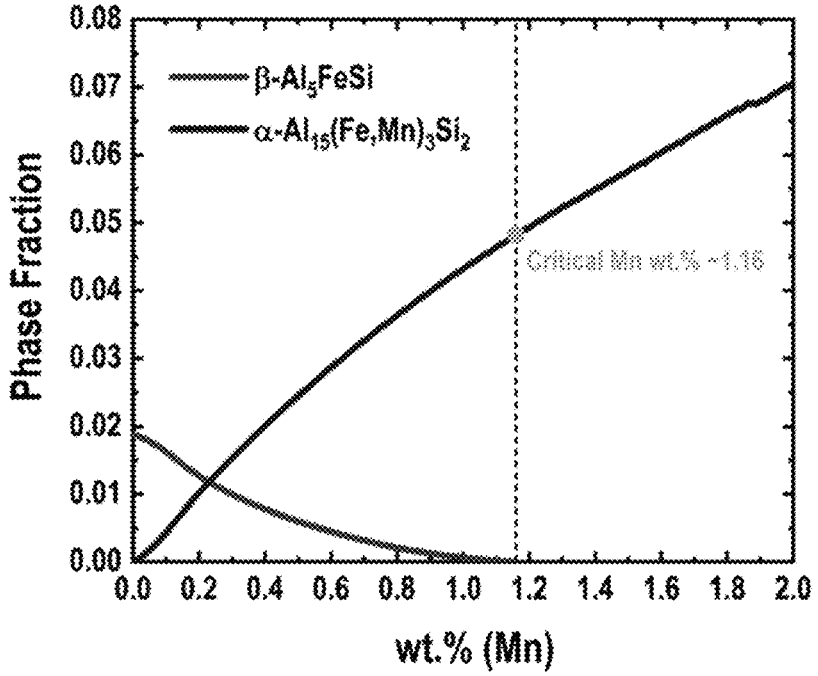
FIG. 3A-3B shows (3A) The change in total phase fraction of Fe-containing intermetallics with Mn concentration for Al-8 pct Si-0.35 pct Mg-0.6 pct Fe; and (3B) the effect of Fe and Mn content on the formation of $\beta$-$Al_5FeSi$ intermetallic phase for composition ranges of 7 to 10 pct Si, 0.35-0.5 pct Mg, 0.1 to 1.3 pct Mn, 0.1 to 1.3 pct Fe.
Figure 3B:
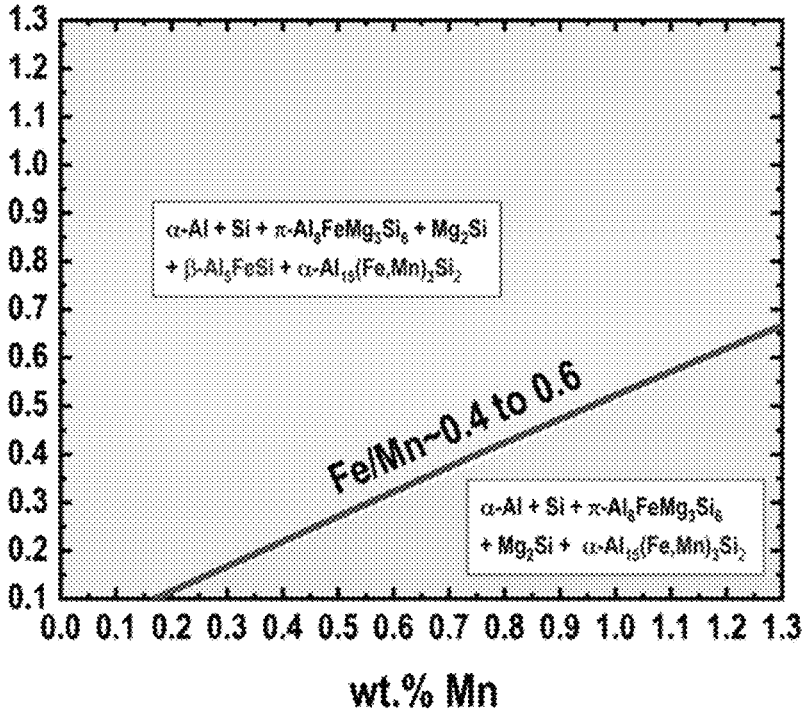
Figure 4A:
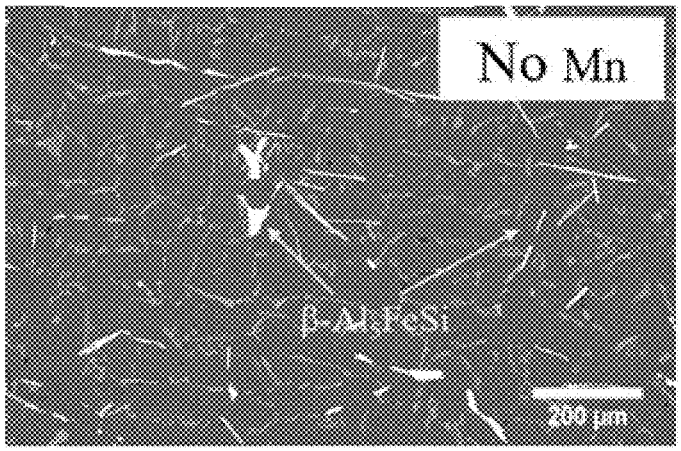
FIG. 4A-4E shows back-scattered SEM images of Al-8 pct Si-0.35 pct Mg alloys solidified in standard cooling cups, (4A) 0.7 pct Fe-0 pct Mn; (4B) 0.7 pct Fe-0.25 pct Mn; (4C) 0.7 pct Fe-0.5 pct Mn; (4D) 0.7 pct Fe-0.75 pct Mn; and (4E) 0.7 pct Fe-1 pct Mn.
Figure 4B:
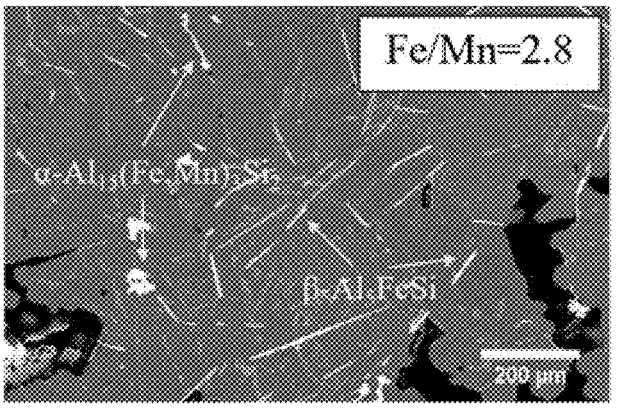
Figure 4C:
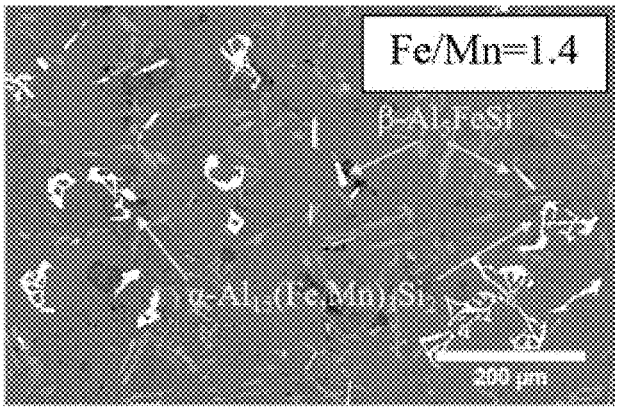
Figure 4D:
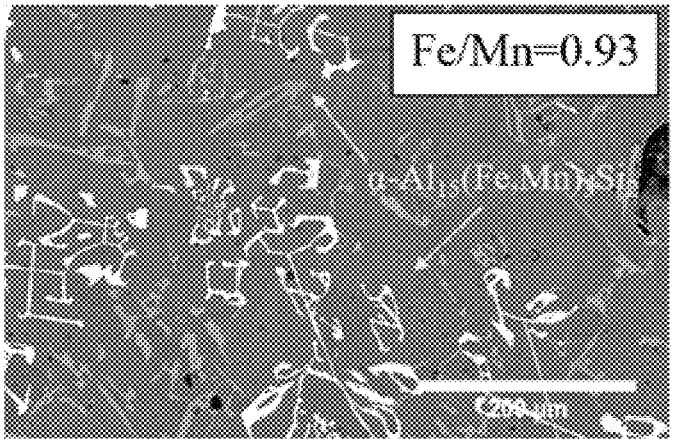
Figure 4E:
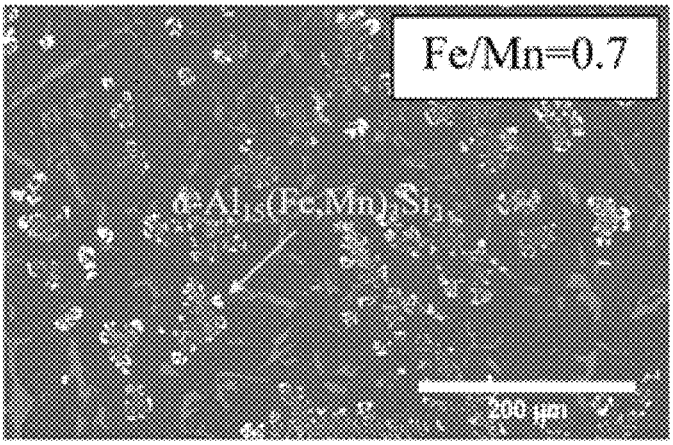

Following the HTC calculations for equilibrium cooling conditions, Scheil solidification simulations were performed to determine critical Mn content under non-equilibrium cooling conditions using HTC function of Pandat. Total phase fraction of Fe—containing intermetallics as a function of Mn content for Al-8 pct Si-0.35 pct Mg-0.6 pct Fe under non-equilibrium cooling conditions is shown in FIG. 3(*a*). The Mn concentration required to eliminate β-phase is determined to be 1.16 pct for 0.6 pct Fe, which is almost two times higher than the critical Mn content required to eliminate β-phase under equilibrium cooling conditions. Fe-to-Mn ratio critical to β-phase formation varies between ~0.4 and 0.6 (FIG. 3(*b*)) within the investigated composition range for non-equilibrium conditions. The simulation results imply that critical Mn content must be higher than Fe concentration to eliminate the β-phase at high cooling rates, which contradicts with the literature.[7]

Casting Experiments

Figure 5:
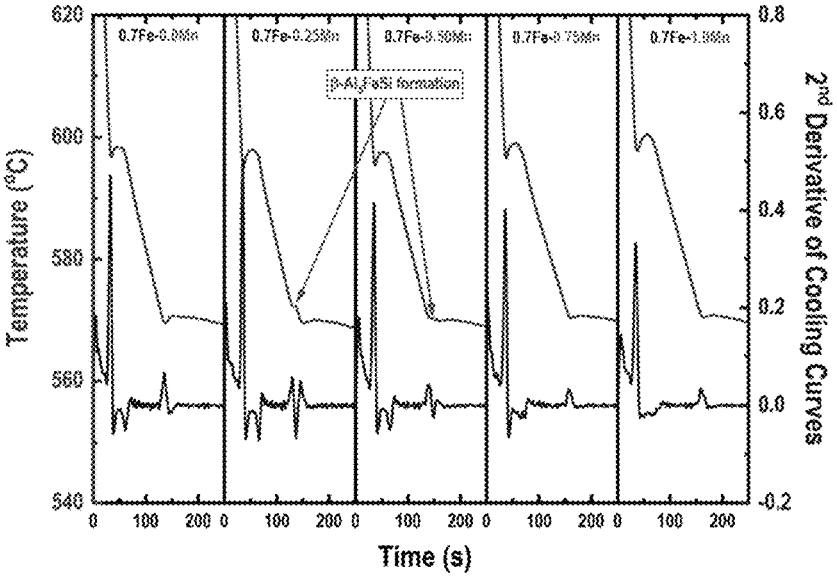
FIG. 5 shows cooling curves of Al-8 pct Si-0.35 pct Mg-0.7 pct Fe alloys with varying levels of Mn (gray lines) obtained from sand cooling cup experiments (0.4° C./s) and second derivative of each cooling curve.
Figure 6A:
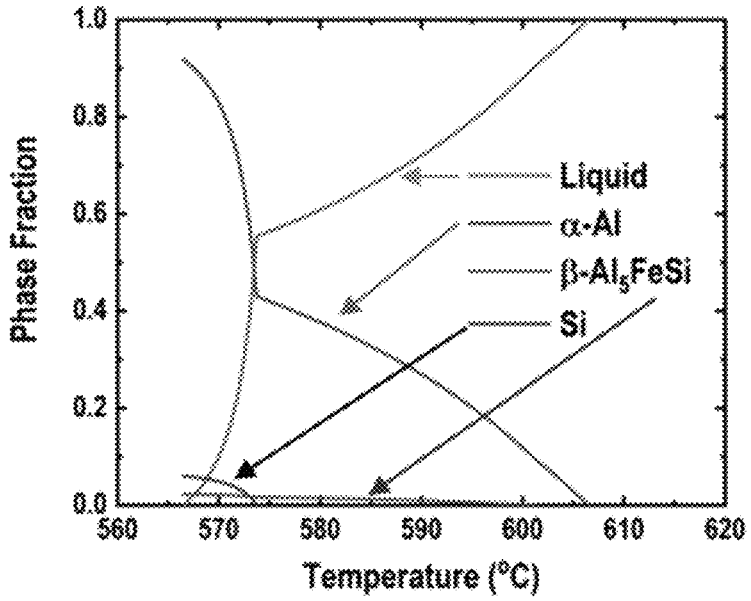
FIG. 6A-6E calculated phase fractions of Al-8 pct Si-0.35 pct Mg alloys solidified in standard cooling cups, (6A) 0.7 pct Fe-0 pct Mn; (6B) 0.7 pct Fe-0.25 pct Mn; (6C) 0.7 pct Fe-0.5 pct Mn; (6D) 0.7 pct Fe-0.75 pct Mn; and (6E) 0.7 pct Fe-1 pct Mn.
Figure 6B:
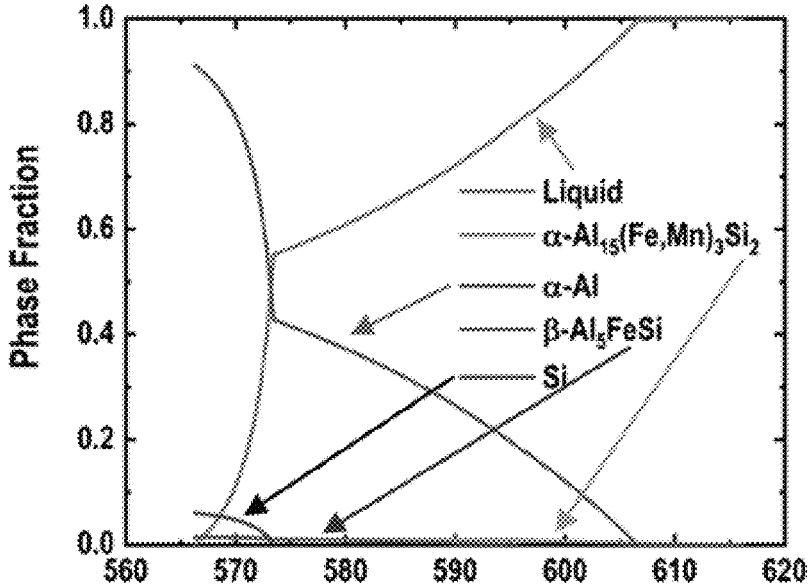
Figure 6C:
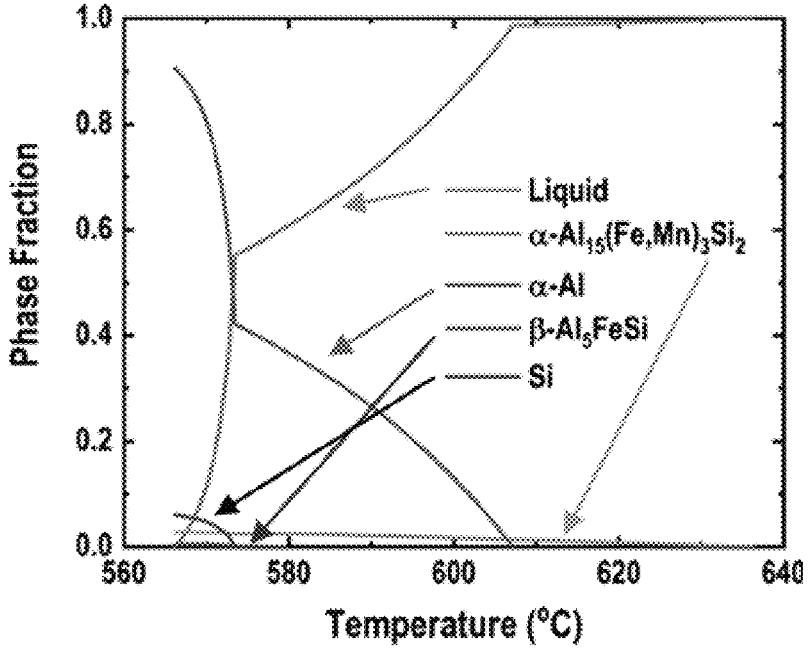
Figure 6D:
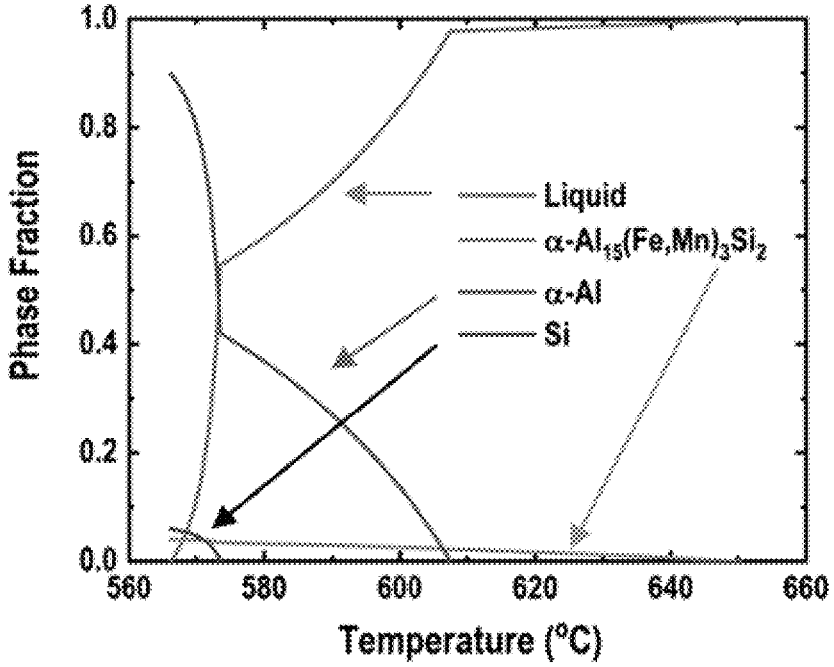
Figure 6E:
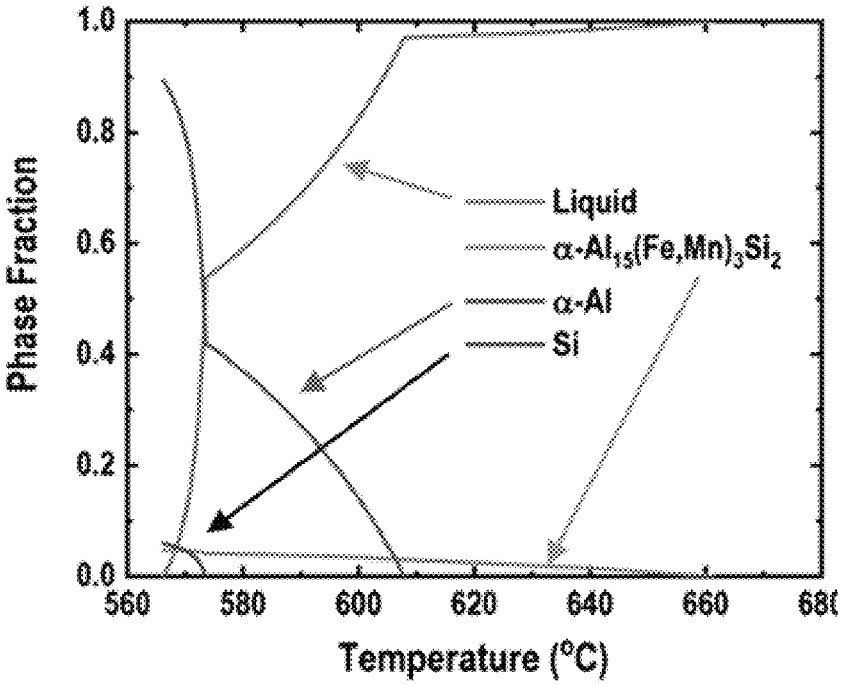
Figure 7A:
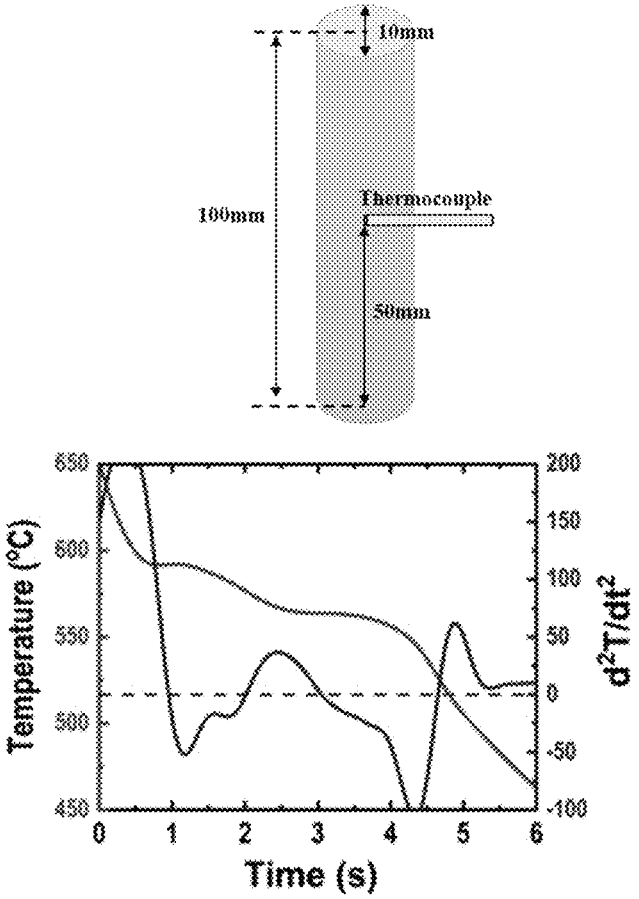
FIG. 7A-7E shows (7A) Schematic of rod castings and an example cooling curve obtained, Back-scattered SEM images of Al-8 pct Si-0.35 pct Mg-1 pct Fe, (7B) 0.4 pct Mn, (7C) 0.6 pct Mn, (7D) 0.8 pct Mn, (7E) 1.2 pct Mn, cooled at a rate of ~30° C./s.
Figure 7B:
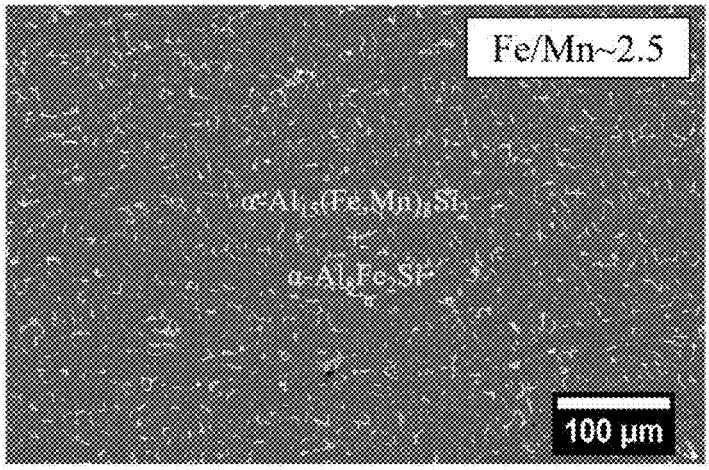
Figure 7C:
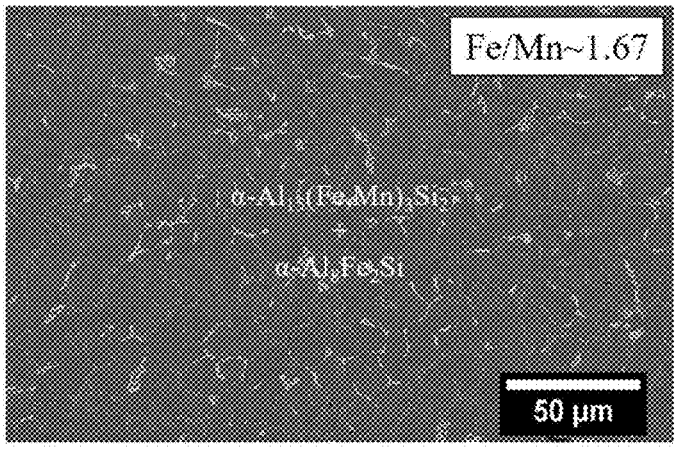
Figure 7D:
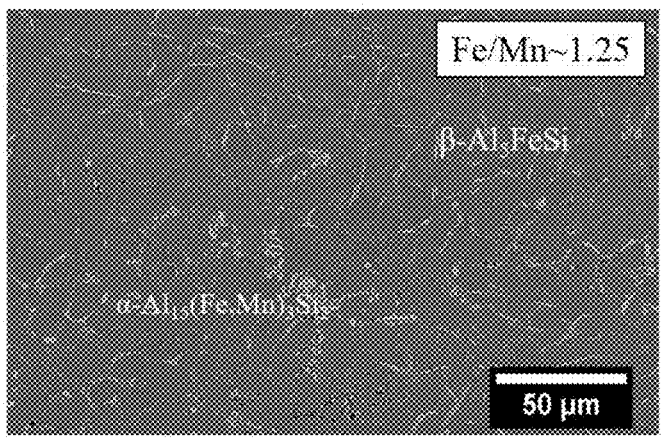
Figure 7E:
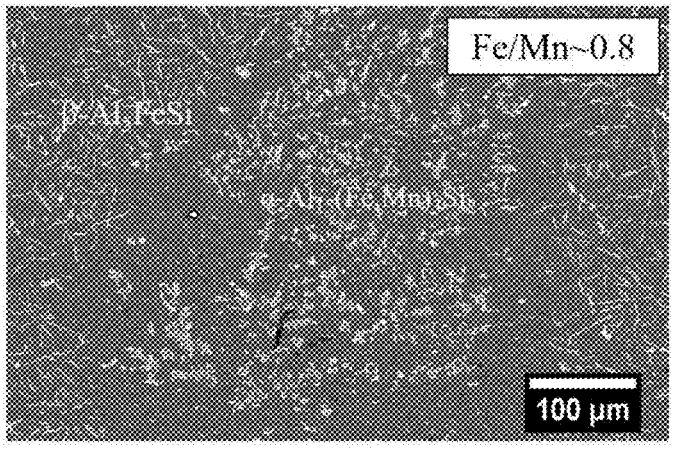
Figure 8A:
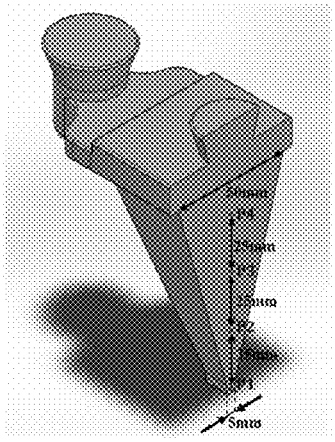
FIG. 8A-8F (8A) Cross-sectional view of wedge casting and locations of thermocouples; (8B) recorded cooling curves for Al-8 pct Si-0.35 pct Mg-0.7 pct Fe-0.25 pct Mn alloy; (8C) back-scattered SEM image from location P1 (~65° C./s); (8D) back-scattered SEM image from location P2 (~5° C./s); (8E) back-scattered SEM image from location P3 (~2° C./s); (8F) back-scattered SEM image from location P4 (~1.5° C./s).
Figure 8B:
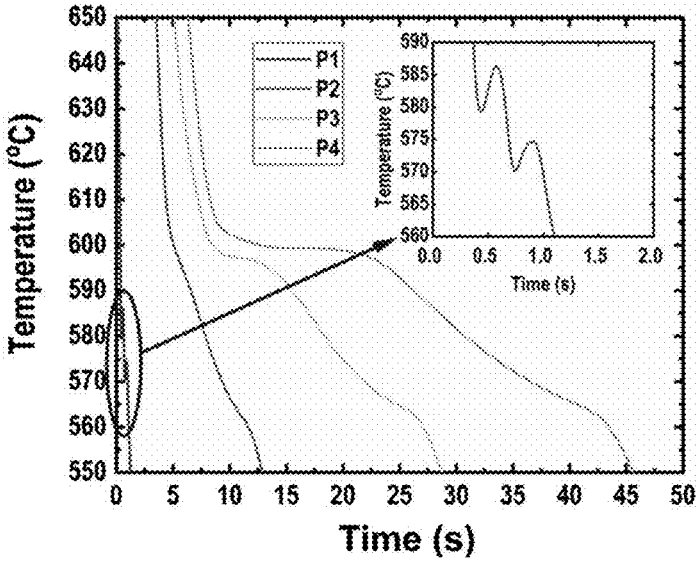
Figure 8C:
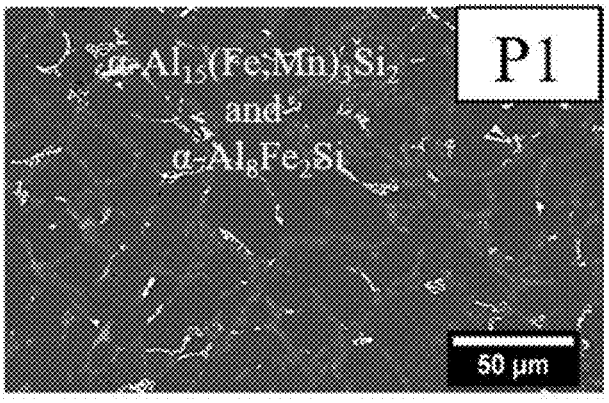
Figure 8D:
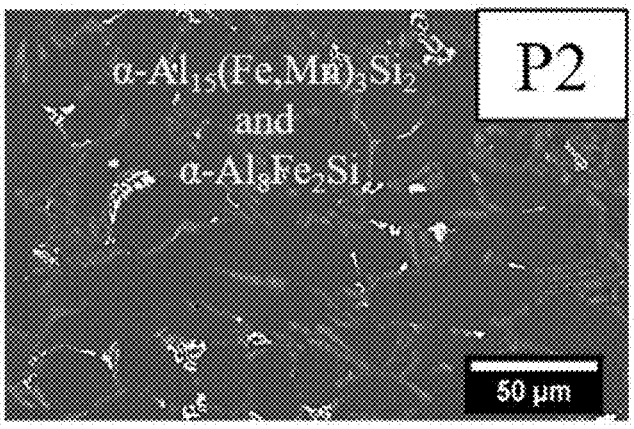
Figure 8E:
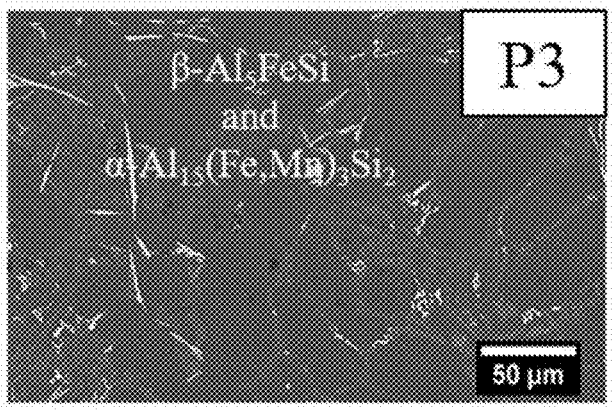
Figure 8F:
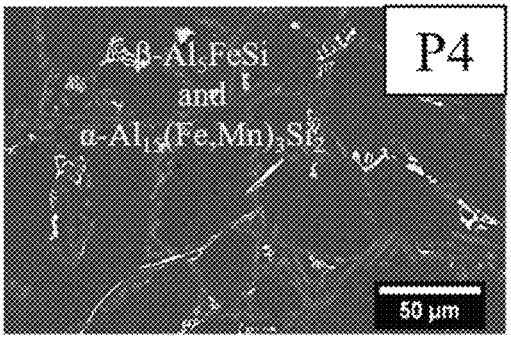

To validate the modeling results for equilibrium and non-equilibrium cooling conditions, alloys of different Fe levels were prepared with varying Fe-to-Mn ratios. The back-scattered SEM images of alloys with 0.7 pct Fe that were cooled at a rate of ~0.4° C./s in a standard sand cooling cup are presented in FIG. 4. As predicted by the equilibrium CALPHAD calculations, the Fe-to-Mn ratio of ~1, completely suppresses the formation of β-$Al_5$FeSi phase and the same ratio holds for the alloys with 0.5, 0.7, and 1 pct Fe as well. The CCA clearly shows that the peak associated with formation of β-$Al_5$FeSi phase in the 2nd derivative of cooling curve vanishes from the alloy with the Fe-to-Mn ratio of ~1 (FIG. 5). The start temperature of β-$Al_5$FeSi phase formation was suppressed with the Mn addition, which can be easily discerned from the cooling curves shown in FIG. 5. The liberated latent heat from the β-$Al_5$FeSi phase formation manifested itself as a knee in the cooling curves of alloys containing 0.25 and 0.5 pct Mn. However, the formation start temperature of β-$Al_5$FeSi phase for the alloy that does not contain any Mn was not observed. This was attributed to greater release of latent heat of primary Al dendrites compared to the heat of formation associated with the β-$Al_5$FeSi phase. Due to the close proximity of the transformation temperatures which are only ~5C apart according to the equilibrium solidification simulation, the β-$Al_5$FeSi formation could not be distinguished from that of the primary Al dendrites when no Mn was present.

According to the equilibrium solidification calculations, the formation of β-$Al_5$FeSi begins after the formation of aluminum dendrites and continues during the eutectic transformation in alloys with 0.7 pct Fe (FIG. 6). However, the primary or pre-dendritic β-$Al_5$FeSi phase is present in alloy without Mn (FIG. 4(*a*)) which has been attributed to heterogeneous nucleation and growth of primary β-$Al_5$FeSi on oxide-bifilms as suggested by Cao and Campbell.[25] The size and volume fraction of pre-eutectic β-$Al_5$FeSi can be limited with an increased level of Mn content (FIGS. 3(*b*) and (*c*)), which suppressed the formation temperature from pre-dendritic to temperatures closer to the eutectic transformation as determined from CCA. The addition of 0.25 pct Mn changes the equilibrium solidification path and α-$Al_{15}(Fe,Mn)_3Si_2$ phase becomes the primary solidification product and continues to form through eutectic reactions with other stable phases. The α-$Al_{15}(Fe,Mn)_3Si_2$ with coarse polyhedral (primary phase) or with Chinese-script morphology was observed in all of Mn-containing alloys. It must be noted that the α-$Al_{15}(Fe,Mn)_3Si_2$ phase was significantly refined when the Mn content increased from 0.75 to 1 pct (FIG. 3(*e*)). This was also observed in secondary aluminum castings produced by HPDCE[15] and the refinement was attributed to increased nucleation of $\alpha$-$Al_{15}(Fe,Mn)_3Si_2$ phase due to enlarged undercooling as a result of increase in liquidus temperature with higher Mn content.

The chemical compositions of intermetallic phases observed in prepared alloys and cooled in sand cooling cups are presented in Table III. In contrast with the CALPHAD calculations that suggest very limited Mn solubility in $\beta$-$Al_5FeSi$ phase, the EDS analyses revealed that large amount of Mn was dissolved in this phase.

Figure 9:
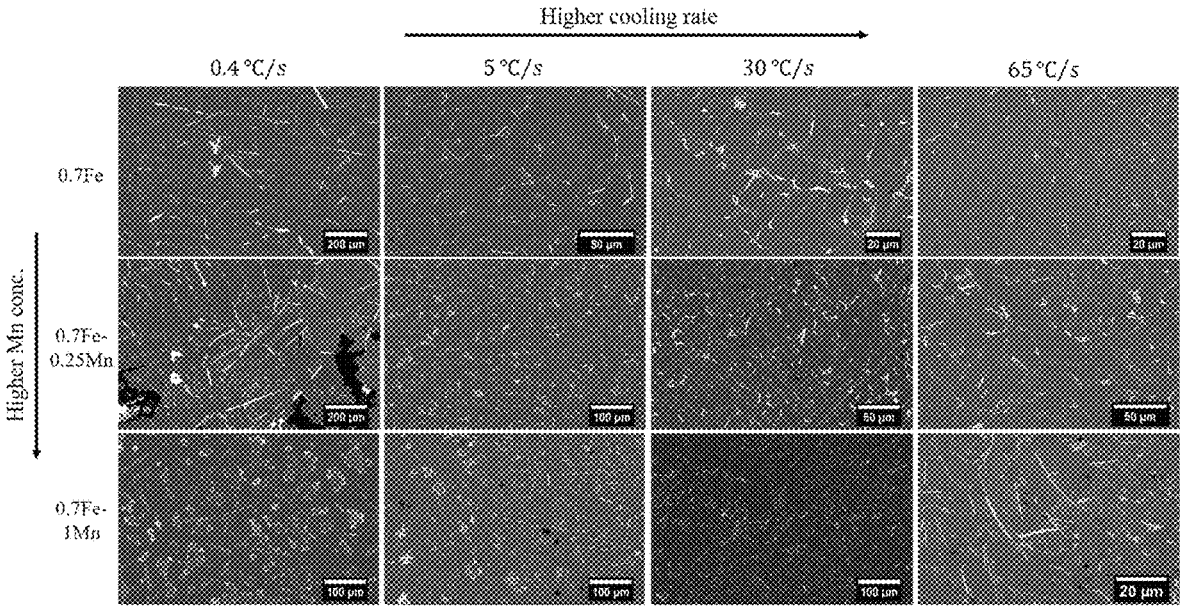
FIG. 9 shows back-scattered SEM images showing effect of cooling rate and Fe/Mn ratio on the microstructure.

The Mn solubility in $\beta$-$Al_5FeSi$ phase was previously reported by Kral.[18] However, Kral's reported solubility limit of 0.5 at. pct is well below the measured value of 2.42 at. pct in this study. On the other hand, the EDS analysis results on the $\beta$-$Al_5FeSi$ phase in alloys without Mn are in good agreement with CALPHAD calculations which suggests sand cooling cup experiments are good representative of equilibrium cooling conditions. The measured chemical composition of $\alpha$-$Al_{15}(Fe, Mn)_3Si_2$ phase is in good agreement with the CALPHAD calculations as well As previously stated, the formation of Fe-containing intermetallics is complicated by superheat, cooling rate, and alloy composition. Depending on the casting parameters, it is possible to obtain a variety of Fe-containing intermetallics with different composition and morphology in the as-cast microstructure of Al—Si alloys. In FIG. 7, back-scattered SEM images of Al-8 pct Si-0.35 pct Mg-1 pct Fe with 0.4, 0.6, 0.8, and 1.2 pct Mn were cooled at a rate of ~30° C./s. The Fe-containing intermetallics observed in 0.4 and 0.6 pct Mn were formed through a eutectic reaction simultaneously with Si phase interdendritically. The compositional analysis of phases with refined Chinese-script morphology is presented in Table IV. The comparison between CALPHAD calculations and EDS results reveals that intermetallic phases were identified as $\alpha$-$Al_8Fe_2Si$ and $\alpha$-$Al_{15}(Fe,Mn)_3Si_2$. Increasing Mn concentration to 0.8 pct led to the formation of intermetallics with needle-like morphology, which were identified as $\beta$-$Al_5FeSi$ phase (Table IV). The further increase of Mn content (1.2 pct) significantly increased $\beta$-$Al_5FeSi$ phase fraction and resulted in the separation of Fe-containing inter-metallic phases in the form of islands of $\alpha$-$Al_{15}(Fe,Mn)_3Si_2$ phase-rich regions surrounded by $\beta$-$Al_5FeSi$ phase regions. To further study the effect of cooling rate on Fe-to-Mn ratio, wedge castings were produced. A set of cooling curves and associated microstructure for Al-8 pct Si-0.35 pct Mg-0.7 pct Fe-0.25 pct Mn alloy are presented in FIG. 8(*b*) as an example. $\beta$-$Al_5FeSi$ phase is present in the microstructure at the slowly cooled regions of the wedge casting. However, 0.25 pct Mn is enough to suppress the formation of $\beta$-$Al_5FeSi$ phase even at the cooling rate of 5° C./s. A set of microstructure images of 0.7 pct Fe level for different cooling rates are presented in FIG. 9. As observed in the case of rod casting samples, the increased concentration of Mn leads to the formation of $\beta$-$Al_5FeSi$ phase formation at high cooling rates while it completely suppressed its formation at slower cooling rates.

TABLE III

Measured and Theoretical Compositions of Fe-Containing Intermetallics From Sand Cooling Cup Castings

| Phase | Morphology | | Al (At. Pct) | Si (At. Pct) | Fe (At. Pct) | Mn (At. Pct) |
|---|---|---|---|---|---|---|
| $\beta$-$Al_5FeSi$* | needle | measured | 64.63 | 19.12 | 14.92 | 0.03 |
| | | CALPHAD | 66.5 | 18.3 | 15.2 | 0.003 |
| $\beta$-$Al_5FeSi$** | needle | measured | 65.04 | 19.26 | 13.04 | 2.12 |
| | | CALPHAD | 66.5 | 18.3 | 15.2 | 0.003 |
| $\alpha$-$Al_{15}(Fe,Mn)_3Si_2$ | Chinese-script/ polyhedral | measured | 69.85 | 11.08 | 10.56 | 7.65 |
| | | CALPHAD | 70.5 | 12.1 | 8.9 | 8.5 |

*The composition of $\beta$-$Al_5FeSi$ phase in alloy that contains no Mn.
**The composition of $\beta$-$Al_5FeSi$ phase in alloys that contains Mn.

TABLE IV

Measured and Theoretical Compositions of Fe-Containing Intermetallics From Rod Castings

| Phase | Morphology | | Al (At. Pct) | Si (At. Pct) | Fe (At. Pct) | Mn (At. Pct) |
|---|---|---|---|---|---|---|
| $\alpha$-$Al_8Fe_2Si$ | refined Chinese script | measured | 74.65 | 10.4 | 12.28 | — |
| | | CALPHAD | 70 | 10.95 | 19 | — |
| $\beta$-$Al_5FeSi$ | needle | measured | 72.93 | 19.69 | 4.63 | 2.76 |
| | | CALPHAD | 66.5 | 18.3 | 15.2 | 0.003 |
| $\alpha$-$Al_{15}(Fe,Mn)_3Si_2$ | refined Chinese script | measured | 74.34 | 10.51 | 9.24 | 5.91 |
| | | CALPHAD | 70.5 | 12.1 | 8.9 | 8.5 |

Formation Map of Fe-Containing Intermetallics

Figure 10:
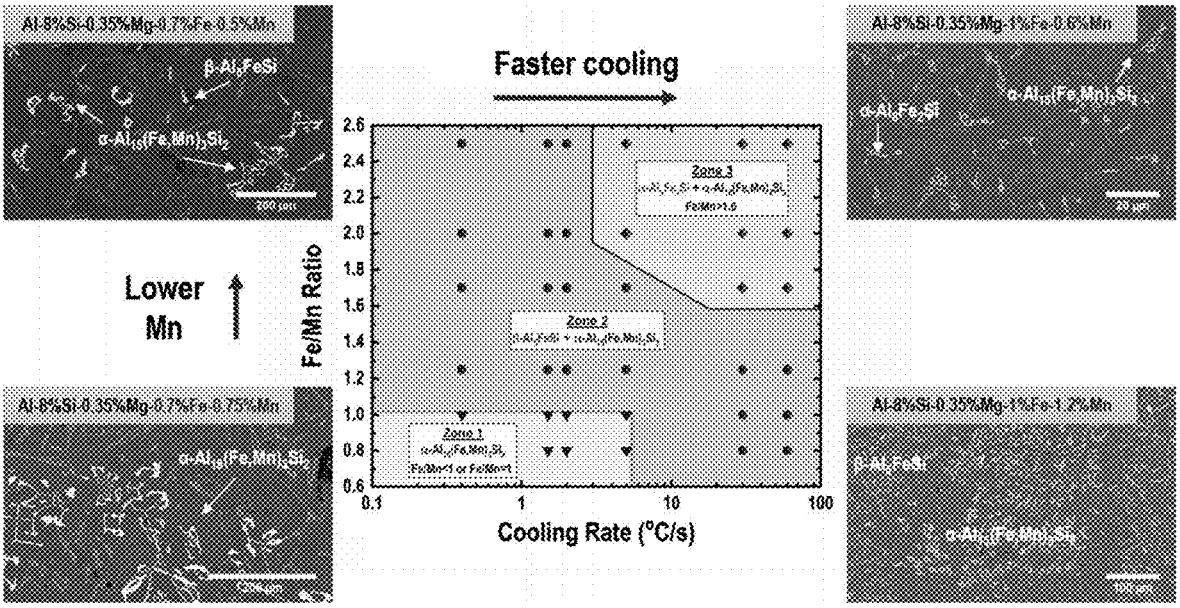
FIG. 10 shows the formation map of Fe-containing intermetallics in Al—Si—Mg casting alloys with high Fe content.

The simulation and experimental results in this study were summarized as a two-dimensional map, shown in FIG. 10, correlating the cooling rate and Fe-to-Mn ratio to the intermetallics formed in the as-cast microstructure. The produced map is a guide for three different levels of Fe 0.5, 0.7, and 1 pct, and indicates that $\beta$-$Al_5FeSi$ can only be eliminated under certain cooling conditions for specific Fe-to-Mn ratios. The two-dimensional map was shown to have three distinct zones, as indicated in FIG. 10. In Zone 1, where the Fe-to-Mn ratio is equal to or less than 1 (higher Mn content than Fe) and the cooling rate ranged from 0.4 to 5° C./s, the only Fe-rich intermetallic observed in the as-cast microstructure was $\alpha$-$Al_{15}(Fe,Mn)_3Si_2$ phase which has less detrimental effect on the as-cast mechanical properties. The relatively slow cooling conditions and high Mn content led to the formation of thermo-dynamically stable $\alpha$-$Al_{15}(Fe,Mn)_3Si_2$ phase, with only a change in the morphology of the intermetallic phase from well-known Chinese-script morphology to a refined polyhedrons. Most of the Fe is accommodated in the $\alpha$-$Al_{15}(Fe,Mn)_3Si_2$, while Mn remains in the solid aluminum due to its high solubility. Therefore, at slow and intermediate cooling rates, Fe-to-Mn ratio must be 1 or lower (more Mn than Fe) to maintain a critical content of Mn in solidifying liquid that forces thermo-dynamic stability of $\alpha$-$Al_{15}(Fe,Mn)_3Si_2$ phase, which preferentially consumes Fe over the $\beta$-$Al_5FeSi$ phase. Otherwise, as in the high Fe-to-Mn ratio region of Zone 2 (more Fe than Mn), a mixture of $\beta$-$Al_5FeSi$ and $\alpha$-$Al_{15}(Fe,Mn)_3Si_2$ phases in the as-cast microstructure was observed at slow cooling rates which cause a loss in alloy ductility. This mixture remains undesirable as even small amounts of $\beta$-$Al_5FeSi$ can degrade mechanical properties.

Figure 11A:
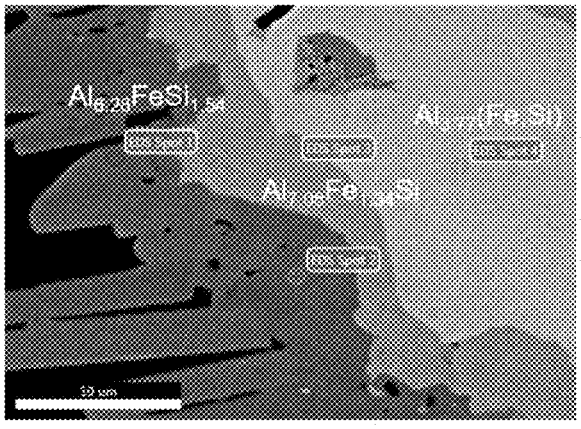
FIG. 11 shows the formation of Fe-rich intermetallics through peritectic reaction in Al-8 pct Si-10 pct Fe alloy: (11A) 0.4° C./s cooling rate; and (11B) 30° C./s cooling rate.
Figure 11B:
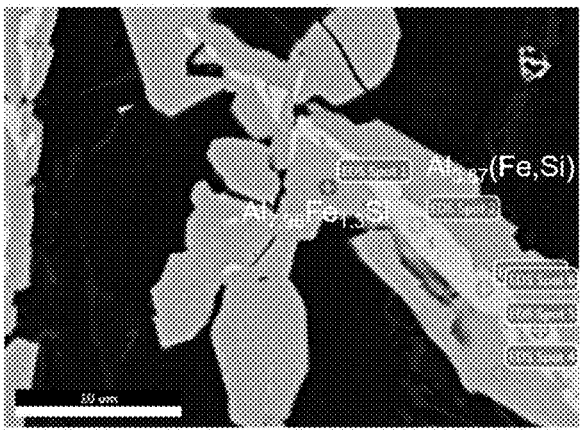

In Zone 3, where Fe-to-Mn ratio is equal to or higher than 1.6 for high cooling rates, non-equilibrium $\alpha$-$Al_8Fe_2Si$ and stable $\alpha$-$Al_{15}(Fe,Mn)_3Si_2$ phases coexist in the as-cast microstructure with compact morphology. Fe and Si are rejected from the solidifying Al, which causes the solidifying liquid to contain high concentrations of Fe and Si at the solid-liquid interface. Since the diffusion of Fe from the solid/liquid interface into the bulk liquid is extremely slow, Fe solute at the solidification front builds up, which causes a local inhomogeneity.[26] Because of this local compositional inhomogeneity, $\theta$-$Al_{13}Fe_4$ phase becomes thermodynamically stable and nucleates. After nucleation of 0 phase, it evolves into $\alpha$-$Al_8Fe_2Si$ and $\beta$-$Al_5FeSi$ sequentially through a peritectic reaction during the solidification.[16] At high cooling rates, it is possible to arrest the $\alpha$-$Al_8Fe_2Si$ phase, before it transforms into the $\beta$-$Al_5FeSi$ phase. To observe this peritectic reaction, an alloy with high Fe concentration (Al-8Si-10Fe-0.35Mg) is prepared and solidified at cooling rates of 0.4° C./s and 30° C./s, respectively. The back-scattered SEM images of Fe-rich intermetallics that undergo the peritectic transformation are presented in FIG. 11. When the cooling rate increased from 0.4° C./s to 30° C./s, the most outer layer of intermetallic ($Al_{63}FeSi_{1.5}$) observed in FIG. 11(*a*) did not form (FIG. 11(*b*)) and the peritectic transformation was terminated at the $Al_{7.96}Fe_{1.3}Si$ layer due to a shorter solidification time. On the other hand, increasing Mn content did not inhibit the $\beta$-$Al_5FeSi$ phase formation at high cooling rates as expected (shown in FIG. 10), but instead promoted the formation of very-fine $\beta$-$Al_5FeSi$ phase particles, surrounding isolated $\alpha$-$Al_{15}(Fe,Mn)_3Si_2$ islands. Even though $\alpha$-$Al_{15}(Fe,Mn)_3Si_2$ is thermodynamically stable, in order to consume the remaining Fe to its structure, Fe diffusion is required. Since Fe diffusion is sluggish in both solid and liquid Al, it is not possible to transfer all the Fe in $\alpha$-$Al_{15}(Fe,Mn)_3Si_2$ phase during rapid cooling. In addition, Fe segregation is increased due to higher content of Mn dissolved in the solid aluminum, which dramatically increases the Fe built-up at liquid/solid interface. Therefore, the peritectic reaction that occurs at a higher cooling rate will lead to the formation of fine $\beta$-$Al_5FeSi$ phase particles.

The formation map presented in this study suggests that Fe-to-Mn ratio that favors the formation of less detrimental $\alpha$-$Al_{15}(Fe,Mn)_3Si_2$ phase is cooling rate dependent. As previously mentioned, the established industry standard is to maintain Fe-to-Mn ratio of 2, if the Fe concentration exceeds 0.45 pct regardless of the cooling conditions. The purpose of suggested ratio is not complete elimination of $\beta$-$Al_5FeSi$ phase from microstructure, but rather reducing the average size of it by pushing its formation start temperature closer to the eutectic solidification temperature. However, the established Fe-to-Mn ratio of 2 may yield the desired microstructure in castings produced by HPDC or permanent mold casting processes, since the rapid cooling conditions can be sufficient to stop the peritectic transformation of $L+\alpha$-$Al_8Fe_2Si \rightarrow \beta$-$Al_5FeSi$ before its completion and yield microstructure that contains both $\alpha$-$Al_8Fe_2Si$ and $\alpha$-$Al_{15}(Fe,Mn)_3Si_2$. However, there would be enough time for peritectic reaction to take place in castings produced with sand casting process and result in the formation $\beta$-$Al_5FeSi$ phase, if there is not enough Mn added to form the stable $\alpha$-$Al_{15}(Fe,Mn)_3Si_2$ phase. Therefore, the required Mn content should be adjusted for different Fe concentrations and cooling conditions to effectively avoid $\beta$-$Al_5FeSi$ phase in the as-cast microstructure.

Conclusion

In summary, the cooling rate-dependent Fe-to-Mn ratios for recyclable Al—Si—Mg-based casting alloys with high Fe contents were determined through CALPHAD-assisted solidification experiments. By establishing the cooling rate dependency of the Fe-to-Mn ratio which suppresses $\beta$-$Al_5FeSi$ allows for increased use of secondary aluminum in casting applications where mechanical properties (especially the ductility) are important. It was observed that, at low and intermediate cooling rates (such as gravity and low-pressure sand casting), an Fe-to-Mn ratio of ~1 is required to inhibit the detrimental $\beta$-$Al_5FeSi$ phase formation and maintain the lowest possible Fe-rich intermetallic volume fraction in the as-cast microstructure. At high cooling rates (such as permanent mold casting and high-pressure die casting), however, Fe-to-Mn ratio higher than ~1.6 is required to obtain a mixture of compact metastable $\alpha$-$Al_8Fe_2Si$ and stable $\alpha$-$Al_{15}(Fe,Mn)_3Si_2$ phases. The required Mn content decreases with increased cooling rate to avoid $\beta$-$Al_5FeSi$ phase formation. By implementing this map, it is possible to optimize the microstructure to improve the mechanical properties, most notably the ductility, in recycled Al—Si—Mg alloys.

REFERENCES

1. A. I. Taub and A. A. Luo: MRS Bull., 2015, vol. 40, pp. 1045-54.
2. J. G. Kaufman and E. L. Rooy: Aluminium Alloy Castings: Properties, Processes, and Applications, ASM International, Cleveland, 2004.
3. M. E. Schlesinger: Aluminum Recycling, 2nd ed., CRC Press, Boca Raton, F L, 2013.
4. W. J. Joost: JOM, 2012, vol. 64, pp. 1032-8.
5. G. Gaustad, E. Olivetti, and R. Kirchain: Resour. Conserv. Recycl., 2012, vol. 58, pp. 79-87.
6. K. Nakajima, O. Takeda, T. Miki, K. Matsubae, S. Nakamura, and T. Nagasaka: Environ. Sci. Technol., 2010, vol. 44, pp. 5594-5600.
7. A. Couture: AFS Int. Cast Met. J., 1981, vol. 6, pp. 9-17.
8. P. N. Crepeau: Trans. Am. Foundrymen's Soc., 1995, vol. 103, pp. 361-66.
9. J. A. Taylor: Proc. Mater. Sci., 2012, vol. 1, pp. 19-33.
10. S. Terzi, J. A. Taylor, Y. H. Cho, L. Salvo, M. Sue'ry, E. Boller, and A. K. Dahle: Acta Mater., 2010, vol. 58, pp. 5370-80.
11. C. M. Dinnis, J. A. Taylor, and A. K. Dahle: Scr. Mater., 2005, vol. 53, pp. 955-58.
12. C. Puncreobutr, A. B. Phillion, J. L. Fife, P. Rockett, A. P. Horsfield, and P. D. Lee: Acta Mater., 2014, vol. 79, pp. 292-303.

13. S. Seifeddine, S. Johansson, and I. L. Svensson: Mater. Sci. Eng. A, 2008, vol. 490, pp. 385-90.
14. J. Y. Hwang, H. W. Doty, and M. J. Kaufman: Mater. Sci. Eng. A, 2008, vol. 488, pp. 496-504.
15. D. Bo¨ sch, S. Pogatscher, M. Hummel, W. Fragner, P. Uggowitzer, M. Go'ken, and H. Ho^ppel: Metall. Mater. Trans. A, 2015, vol. 46A, pp. 1035-45.
16. A. Gorny, J. Manickaraj, Z. Cai, and S. Shankar: J. Alloys Compd., 2013, vol. 577, pp. 103-24.
17. Y. Awano and Y. Shimizu: AFS Trans., 1990, vol. 98, pp. 889-95. 18. M. V. Kral: Mater. Lett., 2005, vol. 59, pp. 2271-76.
19. L. A. Narayanan, F. H. Samuel, and J. E. Gruzleski: Metall. Mater. Trans. A, 1994, vol. 25A, pp. 1761-73.
20. C. M. Dinnis, J. A. Taylor, and A. K. Dahle: Metall. Mater. Trans. A, 2006, vol. 37A, pp. 3283-91.
21. S. G. Shabestari: Mater. Sci. Eng. A, 2004, vol. 383, pp. 289-98.
22. K. Liu, X. Cao, and X. G. Chen: Metall. Mater. Trans. B, 2012, vol. 43B, pp. 1231-40.
23. S. Ji, W. Yang, F Gao, D. Watson, and Z. Fan: Mater. Sci. Eng. A, 2013, vol. 564, pp. 130-39.
24. R. Schmid-Fetzer and F Zhang: Calphad, 2018, vol. 61, pp. 246-63.
25. X. Cao and J. Campbell: Metall. Mater. Trans. A, 2004, vol. 35A, pp. 1425-35.
26. N. Isono, P. Smith, D. Turnbull, and M. J. Aziz: Metall. Mater. Trans. A, 1996, vol. 27A, pp. 725-30.

Example 2: Secondary Alloy Development for Structural Applications

Current structural die cast alloys, such as Silafont 36, Aural 2-5, and EZCast, are all produced from primary aluminum and with very strict limits on Fe content (less than 0.15-0.25%). Fe can form numerous intermetallic phases, such as, $\theta$-$Al_{13}Fe_4$, $\alpha$-$Al_8Fe_2Si$, $\beta$-$Al_5FeSi$, $\delta$-$Al_4FeSi_2$, $\pi$-$Al_8FeMg_3Si_2$, etc., in aluminum alloys depending on other alloying elements and cooling rates during solidification [2]. The size, morphology, and volume fraction of these Fe-containing intermetallics have a pronounced effect on the mechanical properties of aluminum castings. The most common and detrimental Fe-containing intermetallic observed in hypoeutectic Al—Si casting alloys is $\beta$-$Al_5FeSi$ phase which forms as interconnected thin platelets with a needle-like appearance in a polished cross-section. In this project, CALPHAD-based thermodynamic modeling and experimental investigation were carried out to identify proper alloying additions to suppress the formation of $\beta$-$Al_5FeSi$ phase, thus, neutralize the detrimental effect of Fe-containing intermetallics in cast aluminum alloys.

Alloy Design and High Pressure Die Casting Trial

Based on the above modeling and other experimental results detailed in an earlier publication [1], a secondary aluminum alloy with high Fe content and Fe-to-Mn ratio of 2 was designed (Table 1) for structural applications. The Al—Si base alloy ingots with high Fe content (0.44%) was produced by an aluminum recycler, Audubon Metals (Henderson, KY). The composition after degassing was analyzed using optical emission spectroscopy (OES) and the results were listed in Table 3. In this new secondary aluminum alloy, the Si and Mg contents were similar to these in most structural die cast alloys. However, the Fe content was as high as 0.44%. Mn was added at 0.22% to maintain Fe-to-Mn ratio of 2. Besides Fe, other impurities such as Cu and Zn, were also set at higher levels (0.32% Cu and 0.15% Zn) than primary die cast alloys. Sr was kept at 80 ppm for modification of eutectic Si phase.

TABLE 1

Secondary alloy design for structural die casting applications
Alloy Composition (wt. %)

| Si | Mg | Fe | Mn | Cu | Zn | Sr |
|---|---|---|---|---|---|---|
| 8.6 | 0.32 | 0.44 | 0.22 | 0.32 | 0.15 | 80 ppm |

Figure 15A:
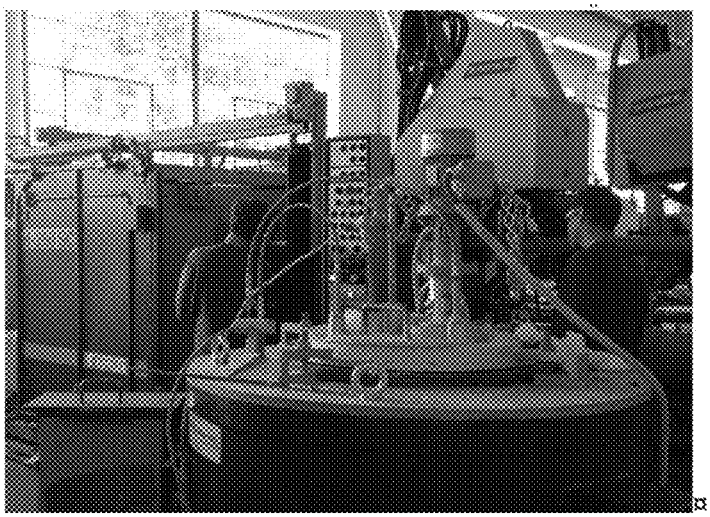
FIG. 15A-15B shows die casting machine (15A) and test specimens (15B) used in die casting trial of the new secondary alloy.
Figure 15B:
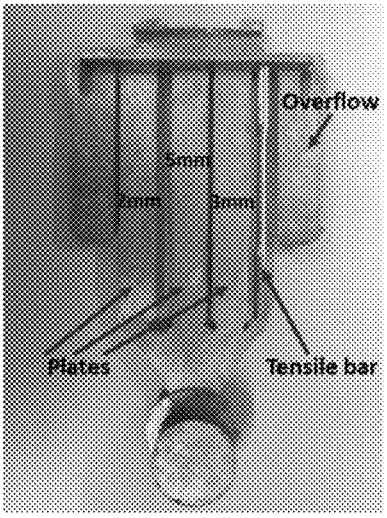

The high pressure die casting (HPDC) trial was conducted at OSU using 250-ton Buhler H-250 SC die casting machine (FIG. 15A), using a test specimen die of a round tensile bar (6 mm diameter in the gauge section) and three flat plates of 2, 3 and 5 mm thicknesses (FIG. 15B). For the die casting trial, the vacuum level was kept as 85 mbar during the process. The die was pre-heated to 205° C. (400° F.) and the shot sleeve was pre-heated to 350° C. (662° F.). Before casting, the melt was degassed using a rotary degassing unit by purging with $N_2$. The molten metal in the holding furnace was kept at 750° C. (1382° F.) during the die casting trial. All castings were quenched in water after ejected from the die.

Heat Treatment and Mechanical Properties

For T5 heat treatment, as-cast specimens were directly artificial aged at 180° C. for 2 hours in a resistance furnace and then quenched in water. For T6 heat treatment, as-cast specimens were solid solutionized at 490° C. for 30 min, followed by water-quench, and then an artificial aging at 180° C. for 2 hours and water quench. The tensile properties of as-cast, T5 and T6 heat treated specimens were determined according to ASTM B557 test procedure. All the tests were conducted using a MTS Model 43 tensile test machine. The flat tensile bars, with a gauge length of 32 mm and width of a 6 mm, were machined from 3 mm-thick cast plates. The round tensile bars tested had a diameter of 6 mm in the gauge section. At least 5 samples were tested for each condition.

Figure 16A:
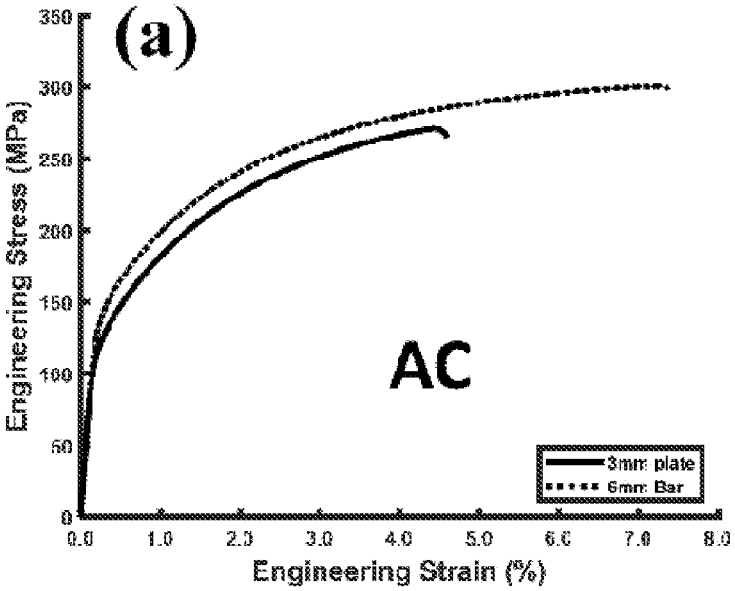
FIG. 16A-16C shows typical tensile curves of the new secondary die cast alloy in 3 mm flat and 6 mm round tensile bars under different conditions: (16A) as-cast; (16B) T5 treated; and (16C) T6 treated.
Figure 16B:
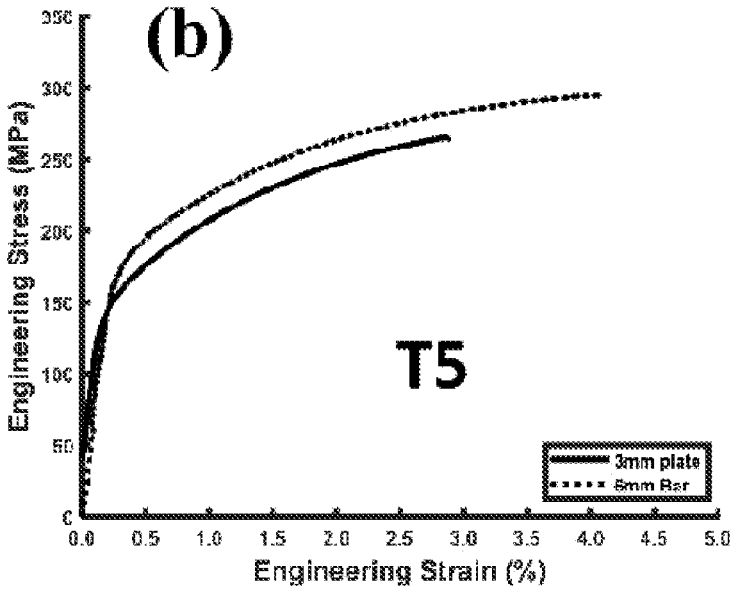
Figure 16C:
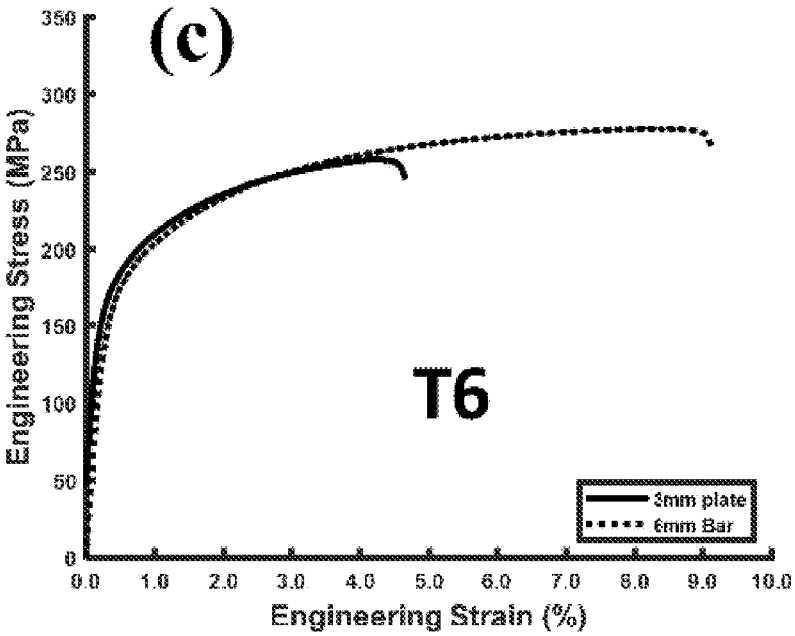
Figure 17A:
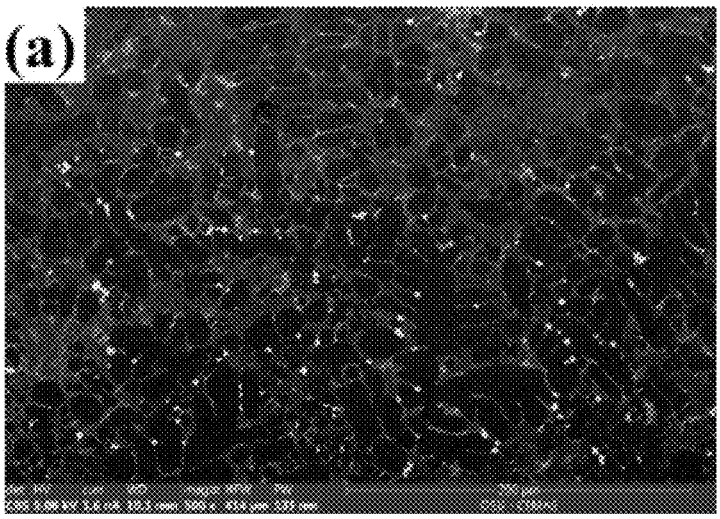
FIG. 17A-17D shows SEM results of as-cast recycled alloy showing: (17A) distribution of second phases; (17B, 17C) morphologies of second phases under high magnifications; and (17D) EDX result of selected points.
Figure 17B:
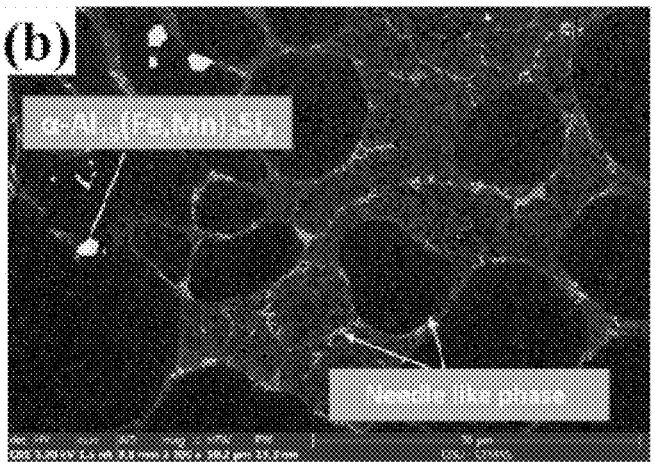
Figure 17C:
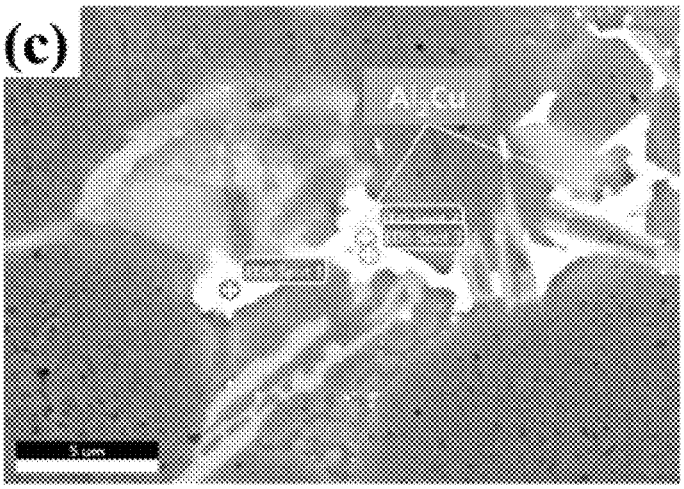
Figure 17D:
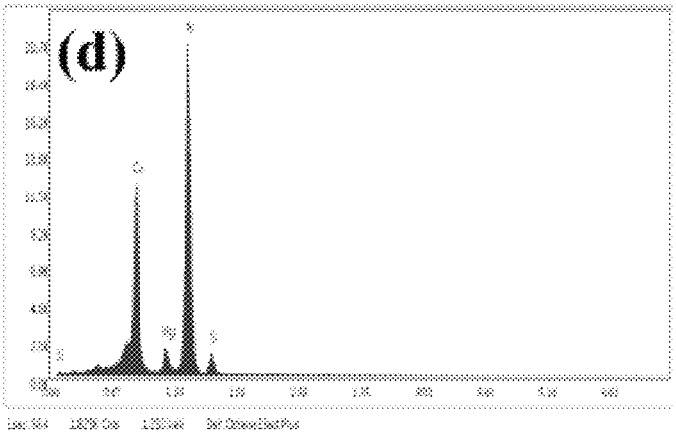
Figure 18A:
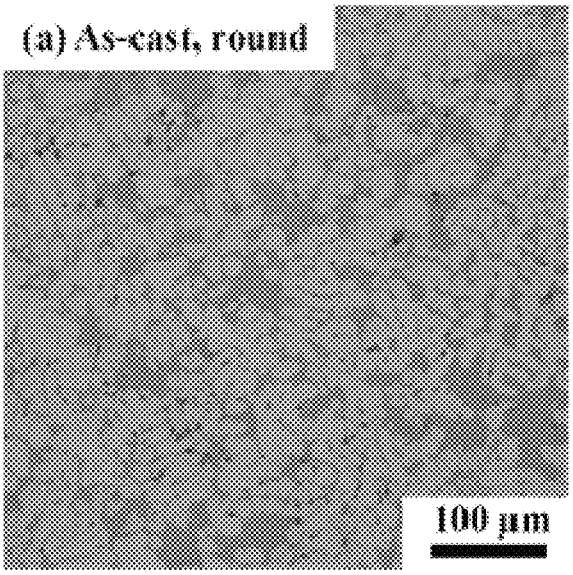
FIG. 18A-18F shows optical micrographs showing the microstructures of the new secondary alloy: (18A, 18B) as-cast; (18C, 18D) T5; and (18E, 18F) T6 treated samples of round and 3 mm-thick flat samples.
Figure 18B:
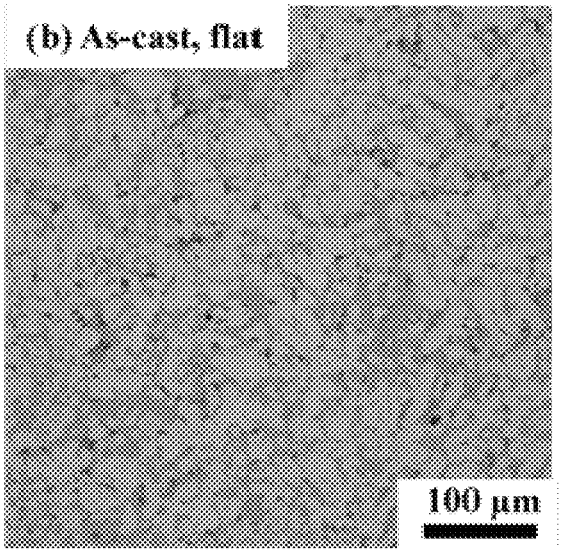
Figure 18C:
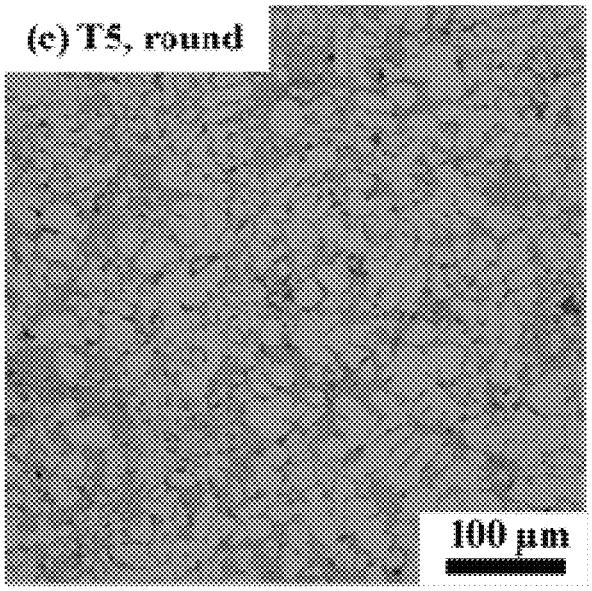
Figure 18D:
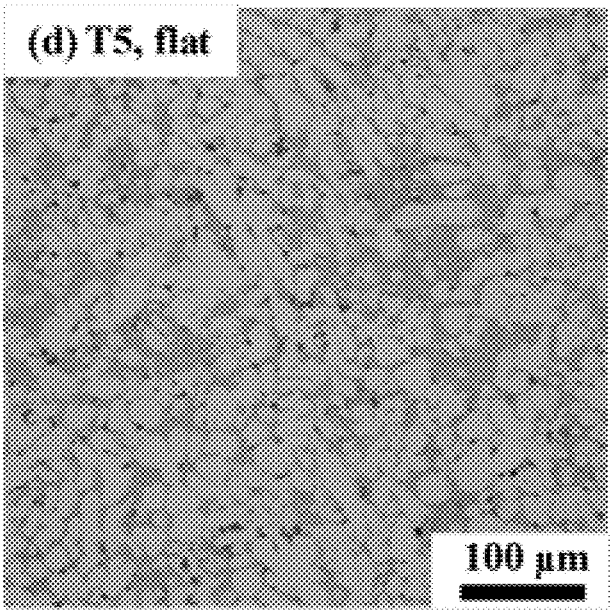
Figure 18E:
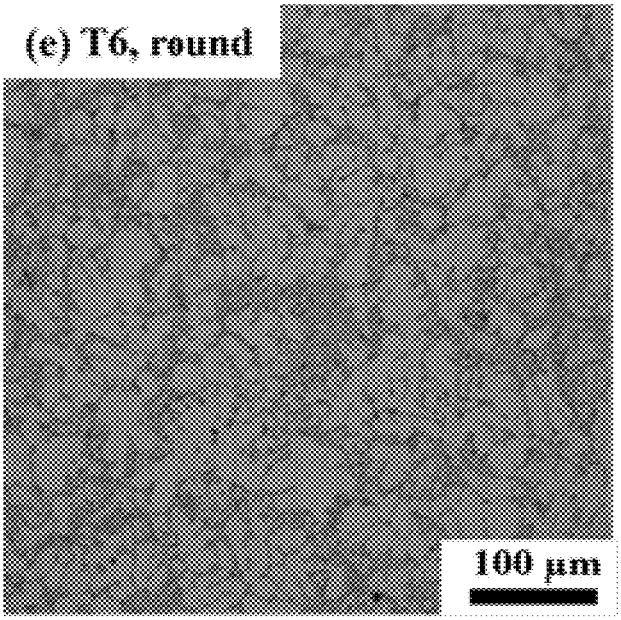
Figure 18F:
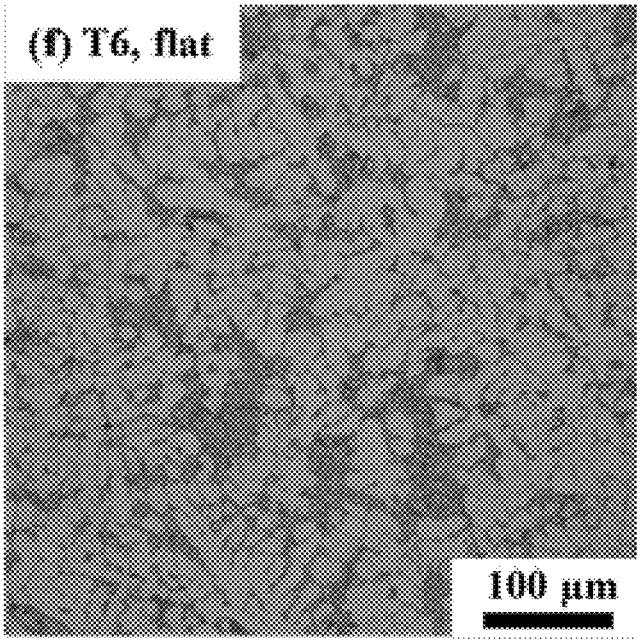
Figure 19:
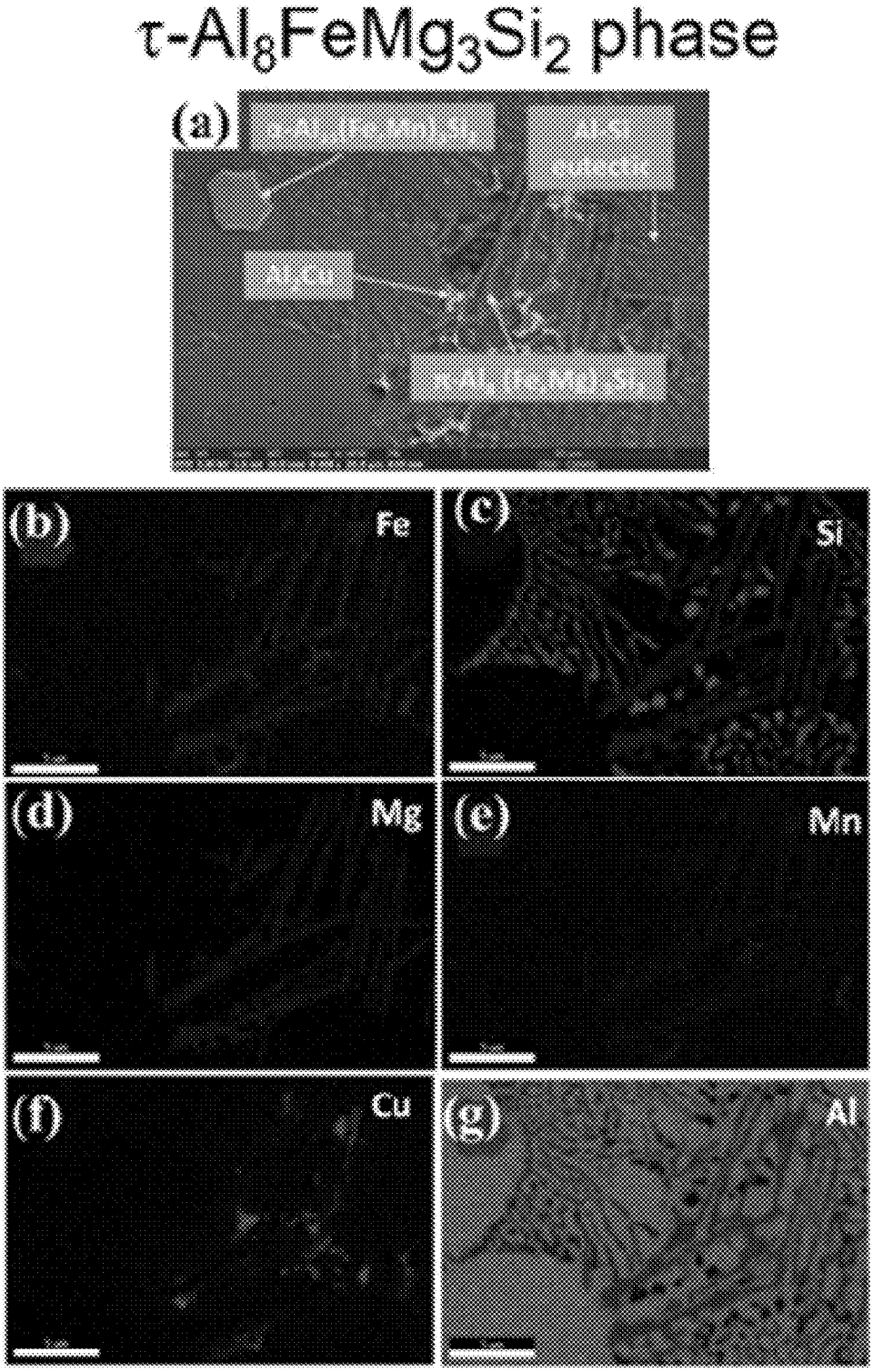
FIG. 19 shows SEM results of as-cast recycled alloy showing (a) $\alpha$-$Al15_5(Fe,Mn)_3Si_2$ phase and $Al_2Cu$ and the second phases around $Al_2Cu$; and (b-g) element mapping of Fe, Si, Mg, Mn, Cu and Al, respectively.

FIG. 16 shows typical tensile curves of the new secondary die cast alloy in 3 mm flat and 6 mm round tensile bars under as-cast, T5 and T6 conditions. For as-cast samples (FIG. 16*a*), the yield strength is about 140 MPa in both plate and round samples, which is similar to those of most primary Al structural alloys. On the other hand, promising elongation of about 4.5-7.5% is achieved in 3 mm plate and 6 mm round bars. It is widely acknowledged that high Fe content (above 0.3%) would result in low ductility in die cast alloys, which prevents the use of recycled alloys in structural applications. However, the tensile properties of this recycled alloy with 0.44% Fe are comparable with those of primary structural alloys with low Fe content (less than 0.25%). For T5 treated samples in FIG. 16*b*, the yield strength is increased to about 180 MPa and 160 MPa at the expense of elongation (4% and 3%) in round and plate samples, respectively. In T6 conditions (FIG. 16*c*), it is interesting to note that both yield strength and elongation are increased to 210 MPa and 9% for the round samples. Similarly, the tensile yield strength is improved to about 210 MPa in T6 treated flat samples with similar elongation (4-5%) compared with those of as-cast samples.

Microstructural Characterization

The microstructure of as-cast, T5 and T6 treated specimens was examined using an Olympus optical microscope and an Apreo I (FEI Apreo LoVac Analytical) high resolution scanning electrical microscope (SEM). The composition of phases was measured by Energy-dispersive X-ray spectroscopy (EDX) and element mapping. The samples were polishing to 2000 grit by SiC paper and further polished to 0.05 μm by colloidal silica before observation.

FIG. 17 shows SEM results of as-cast microstructure of the new secondary alloy. As shown in FIG. 17*a*, the as-cast microstructure consists of α-Al grains surrounded by eutectic phases. There are some primary $\alpha$-$Al_{15}(Fe,Mn)_3Si_2$ phase particles in the interdendritic regions with a rounded or hexagonal morphology, which is consist with the alloy design to avoid the formation of $\beta$-$Al_5FeSi$ phase. As shown in FIG. 17*b*, these needle-like particles are confined to the interdendritic zones, and are significantly smaller than typical $\beta$-$Al_5FeSi$ phase scripts in cast aluminum alloys [2]. The higher magnification SEM image in FIG. 17*c* suggests that these needles are with a length of about 5-10 μm. In addition to the needle-like phase, a more globular phase is distributed in the eutectic region and was identified as $Al_2Cu$ phase from the EDX results in FIG. 17*d*.

FIG. 18 shows the optical microstructure of the new alloy under as-cast, T5 and T6 conditions, in both round and 3 mm-thick flat samples. Compared with the as-cast microstructure in FIGS. 18*a* and 18*b*, the α-Al dendrites do not show any significant changes after T5 (FIGS. 18*c* and 18*d*) or T6 (FIGS. 18*e* and 18*f*) treatment, indicating good thermal stability of the grain structure during heat treatment. For eutectic regions, the typical morphology is still present after heat treatment (T5 and T6).

In conclusion, a new secondary alloy Al-8.6Si—0.32Mg-0.44Fe-0.32Cu-0.22Mn-0.15Zn alloy, prepared from recycled aluminum, offers attractive mechanical properties in as-cast (HPDC) and heat-treated conditions, similar to those of primary die cast alloys for structural applications.

REFERENCES

1. M. P. Moodispaw, E. Cinkilic, A. A. Luo, "Thermodynamic Modeling of Solid Flux Interactions with Molten Aluminum", American Foundry Society Transactions, Paper 2021-034.
2. E. Cinkilic, C. D. Ridgeway, X. Yan, A. A. Luo, "A Formation Map of Iron-Containing Intermetallic Phases in Recycled Cast Aluminum Alloys", Metallurgical and Materials Transactions A, 2019, 50A, 5945-5956.

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. Further, while only certain representative compositions and method steps disclosed herein are specifically described, other combinations of the compositions and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated.

What is claimed is:

1. A method of forming an aluminum alloy, the method comprising:

combining a secondary aluminum alloy with manganese to form the aluminum alloy; and cooling the aluminum alloy;

wherein the aluminum alloy comprises:

aluminum;

silicon;

from greater than 0.3% by weight to 1% by weight iron, based on the total weight of the aluminum alloy;

from 0.1% by weight to 1.3% by weight manganese, based on the total weight of the aluminum alloy; and from 0.005% by weight (50 ppm) to 0.018% by weight (180 ppm) strontium, based on the total weight of the aluminum alloy;

wherein the manganese is present in amount effective to suppress the formation of a $\beta$-$Al_5FeSi$ phase during casting of the aluminum alloy, wherein the iron and manganese are present in an iron to manganese ratio of from 1.6:1 to 2.6:1, and wherein the cooling comprises cooling the aluminum alloy at a cooling rate ranging from 3° C./s to 350° C./s.

2. The method of claim 1, wherein the strontium is present in an amount of from 0.005% by weight (50 ppm) to 0.015% by weight (150 ppm), based on the total weight of the aluminum alloy.

3. The method of claim 1, wherein when the iron and the manganese are present in an iron to manganese ratio of 1:1 or less, the cooling comprises cooling the aluminum alloy at a cooling rate ranging from 0.1° C./s to 4° C./s.

4. The method of claim 3, wherein the iron to manganese ratio is from 0.6:1 to 1:1.

5. A method of improving mechanical properties of a secondary aluminum alloy, the method comprising:

adding manganese to the secondary aluminum alloy to form the aluminum alloy having improved mechanical properties; and cooling the aluminum alloy having improved mechanical properties;

wherein the aluminum alloy having improved mechanical properties comprises:

aluminum;

silicon;

from greater than 0.3% by weight to 1% by weight iron, based on the total weight of the aluminum alloy; and from 0.1% by weight to 1.3% by weight manganese, based on the total weight of the aluminum alloy; and from 0.005% by weight (50 ppm) to 0.018% by weight (180 ppm) strontium, based on the total weight of the aluminum alloy;

wherein the manganese is present in amount effective to suppress the formation of a $\beta$-$Al_5FeSi$ phase during casting of the aluminum alloy, wherein the iron and manganese are present in an iron to manganese ratio of from 1.6:1 to 2.6:1, and wherein the cooling comprises cooling the aluminum alloy at a cooling rate ranging from 3° C./s to 350° C./s.

6. The method of claim 5, wherein the strontium is present in an amount of from 0.005% by weight (50 ppm) to 0.015% by weight (150 ppm), based on the total weight of the aluminum alloy.

7. The method of claim 5, wherein when the iron and the manganese are present in an iron to manganese ratio of 1:1 or less, the cooling comprises cooling the aluminum alloy at a cooling rate ranging from 0.1° C./s to 4° C./s.

8. The method of claim 7, wherein the iron to manganese ratio is from 0.6:1 to 1:1.

9. The method of claim 1, wherein the strontium is present in an amount of from 0.005% by weight (50 ppm) to 0.010% by weight (100 ppm), based on the total weight of the aluminum alloy.

10. The method of claim 1, wherein the strontium is present in an amount of from 0.005% by weight (50 ppm) to 0.016% by weight (160 ppm), based on the total weight of the aluminum alloy.

11. The method of claim 5, wherein the strontium is present in an amount of from 0.005% by weight (50 ppm) to 0.010% by weight (100 ppm), based on the total weight of the aluminum alloy.

12. The method of claim 5, wherein the strontium is present in an amount of from 0.005% by weight (50 ppm) to 0.016% by weight (160 ppm), based on the total weight of the aluminum alloy.

* * * * *